US011293206B2

(12) United States Patent
Shimizu et al.

(10) Patent No.: US 11,293,206 B2
(45) Date of Patent: Apr. 5, 2022

(54) LOCK DEVICE FOR OPENING/CLOSING DEVICE

(71) Applicant: Piolax, Inc., Yokohama (JP)

(72) Inventors: Toshihiro Shimizu, Yokohama (JP); Hisashi Nakasone, Yokohama (JP)

(73) Assignee: PIOLAX, INC., Yokohama (JP)

( * ) Notice: Subject to any disclaimer, the term of this patent is extended or adjusted under 35 U.S.C. 154(b) by 572 days.

(21) Appl. No.: 16/162,493

(22) Filed: Oct. 17, 2018

(65) Prior Publication Data

US 2019/0048626 A1 Feb. 14, 2019

Related U.S. Application Data

(63) Continuation of application No. 14/382,208, filed as application No. PCT/JP2013/053332 on Feb. 13, 2013, now Pat. No. 10,132,108.

(30) Foreign Application Priority Data

Mar. 2, 2012 (JP) ..... 2012-046986
May 29, 2012 (JP) ..... 2012-121668

(51) Int. Cl.
*E05B 83/30* (2014.01)
*E05B 63/20* (2006.01)
(Continued)

(52) U.S. Cl.
CPC ..... *E05B 83/30* (2013.01); *E05B 1/0038* (2013.01); *E05B 63/0052* (2013.01);
(Continued)

(58) Field of Classification Search
CPC .... E05B 83/30; E05B 1/0038; E05B 63/0052; E05B 63/20; E05B 63/202; E05B 63/248;
(Continued)

(56) References Cited

U.S. PATENT DOCUMENTS 712,078 A 10/1902 Look
1,330,693 A 2/1920 Fisher
(Continued)

FOREIGN PATENT DOCUMENTS

CN 2534322 Y * 2/2003
CN 2534322 Y 2/2003
(Continued)

*Primary Examiner* — Alyson M Merlino
(74) *Attorney, Agent, or Firm* — McGinn I.P. Law Group, PLLC.

(57) ABSTRACT

An opening/closing body locking device for an opening/closing body that is openably/closably mounted to an opening portion of a stationary body, the locking device including locking portions provided on both lateral sides of the opening/closing body, a pair of link rods that are mounted to the stationary body, and are interlocked with each other to slidably move so that hook portions at distal ends thereof engage and disengage the locking portions, a biasing unit that biases the link rods in directions that the hook portions of the link rods engage the locking portions, and an operating member that causes the hook portions of the link rods to slide in directions that the hook portions disengage the locking portions against biasing force of the biasing unit,
(Continued)

pressing members that are provided on the both lateral sides of the opening portion of the stationary body.

11 Claims, 24 Drawing Sheets

(51) Int. Cl.
*E05C 9/04* (2006.01)
*E05B 63/24* (2006.01)
*E05B 63/00* (2006.01)
*E05B 1/00* (2006.01)

(52) U.S. Cl.
CPC ..... *E05B 63/20* (2013.01); *E05B 63/248* (2013.01); *E05C 9/047* (2013.01); *E05C 9/043* (2013.01); *Y10T 292/0911* (2015.04)

(58) Field of Classification Search
CPC ..... E05C 9/047; E05C 9/043; E05C 9/048; E05C 9/04; Y10T 292/0807; Y10T 292/0825; Y10T 292/0826; Y10T 292/0832; Y10T 292/0831; Y10T 292/0829; Y10T 292/0839; Y10T 292/084; Y10T 292/0844; Y10T 292/0845; Y10T 292/0911; Y10T 292/0929; Y10T 292/093; Y10T 292/0932; Y10T 292/0933; Y10T 292/0946; Y10T 292/0947; Y10T 292/0948; Y10T 292/0949; Y10S 292/11; Y10S 292/37
See application file for complete search history.

(56) References Cited

U.S. PATENT DOCUMENTS

| | | | |
|---|---|---|---|
| 1,378,447 | A | 5/1921 | Gebhard |
| 1,391,005 | A | 9/1921 | Palmer |
| 1,585,343 | A | 5/1926 | Good |
| 1,652,616 | A | 12/1927 | Drouin |
| 1,662,450 | A | 3/1928 | Anderson |
| 2,162,929 | A | 6/1939 | Armstrong |
| 2,293,363 | A | 8/1942 | Shell |
| 2,298,598 | A | 10/1942 | Sitter |
| 2,481,459 | A | 9/1949 | Whitney |
| 2,597,056 | A | 5/1952 | Bender |
| 2,710,216 | A | 6/1955 | Eichacker |
| 2,910,857 | A | 11/1959 | Muessel |
| 3,123,387 | A | 3/1964 | Jackson et al. |
| 4,926,663 | A | 5/1990 | Azzalin |
| 5,531,492 | A | 7/1996 | Raskevicius |
| 2006/0055196 | A1 | 3/2006 | Yamada |
| 2006/0267364 | A1 | 11/2006 | Katagiri |
| 2007/0080542 | A1 | 4/2007 | Ookawara |

FOREIGN PATENT DOCUMENTS

| | | | | | |
|---|---|---|---|---|---|
| CN | 1511732 | A | * | 7/2004 | ..... E05B 83/30 |
| CN | 101323280 | A | * | 12/2008 | ..... E05B 83/30 |
| CN | 102328621 | A | * | 1/2012 | ..... E05B 83/30 |
| EP | 0547746 | A1 | * | 6/1993 | ..... E05B 65/1013 |
| GB | 398283 | A | * | 9/1933 | ..... E05B 63/20 |
| JP | 4245528 | B2 | * | 3/2009 | |
| JP | 2009180028 | A | * | 8/2009 | |
| JP | 4412234 | B2 | * | 2/2010 | ..... E05B 83/30 |
| WO | WO-2006030610 | A1 | * | 3/2006 | ..... E05B 83/30 |

* cited by examiner

LOCK DEVICE FOR OPENING/CLOSING DEVICE

CROSS-REFERENCE TO RELATED APPLICATIONS

The present application is a Continuation Application of U.S. patent application Ser. No. 14/382,208 filed on Aug. 29, 2014, which is based on International Patent Application No. PCT/JP2013/053332 filed on Feb. 13, 2013, and which claims priority from Japanese Patent Application Nos. 2012-046986 and 2012-121608, filed on Mar. 2, 2012 and May 29, 2012, respectively, the entire contents of which are hereby incorporated by reference.

TECHNICAL FIELD

The present invention relates to an opening/closing body locking device that is used to lock an opening/closing body in a closed state. The opening/closing body is openably/closably mounted to an opening portion of a stationary body.

BACKGROUND ART

For example, an opening/closing body such as a lid is openably/closably mounted to an opening portion formed in a stationary body such as a glove box of an automobile. Further, there is provided a locking device for locking the lid in a closed state with respect to the opening portion, and for bringing the lid into an opened state from the opening portion.

As this kind of locking device, there is known a locking device including a lid openably/closably mounted to an opening portion, a rod mounted to the lid so as to be slidable, and a return spring that biases a distal end of the rod in a direction to protrude toward a concave portion on an inner surface of the opening portion. However, in this locking device, upon closure of the lid, the rod fits into the concave after it temporarily retracts, that is, after a tapered portion formed at the back surface side of the distal end of the rod collides against the circumference of the opening portion and slides thereon. Thus, there may arise a problem of collision noise caused by the rod colliding against the circumference of the opening portion.

In order to solve the above-described problem, Patent Document 1 describes a vehicular storage device that includes an opening/closing member, a concave portion provided to an interior member, a rod passing through the concave portion, a return spring biasing the rod in a direction to fit into the concave portion, one pin that prevents the rod from returning to the state of fitting into the concave portion after the rod is pushed out from the concave portion against the biasing force of the return spring to move the opening/closing member toward an open position, and a pin biasing spring that biases the pin from the opening/closing member in a direction of penetrating into a moving track of the rod.

In the above-described vehicular storage device, in a state where the opening/closing member closes the interior member, the pin is biased by the pin biasing spring to be brought into elastically contact with the interior member while the distal end of the rod fits into the concave portion of the interior member, and thus the opening/closing member is locked in a closed state. When an operating member is operated in this state, the distal end of the rod is pulled from the concave portion against the biasing force of the return spring, and the opening/closing member is opened from the interior member. At this time, while the rod is pushed outward by the biasing force of the return spring, a convex portion provided to the rod engages into a cylinder portion on a base end of the pin to restrict an outward-protruding amount of the rod. Thus, a lapping tab between the distal end of the rod and the inner surface of the interior member upon closure of the opening/closing member can be reduced, and a sliding-contact noise can be reduced.

CITATION LIST

Patent Literature

Patent Document 1

JP-4245528-B

SUMMARY OF THE INVENTION

Problem that the Invention is to Solve

However, in the vehicular storage device of Patent Document 1, in a state where the opening/closing member is opened, it is impossible to eliminate a hitting noise, because the entire distal end of the rod cannot be pulled into the position of being not in contact with the inner surface of the interior member.

In addition, although the above-described general locking device has a configuration such that the distal end of the rod enters into the concave portion to be engaged therein, there may be play between the distal end of the rod and the concave portion depending on dimension accuracy and the like. In this regard, in the vehicular storage device of Patent Document 1, one pin biased with the pin biasing spring is brought into elastically contact with the interior member to bias the opening/closing member in a direction to open the opening/closing member in a state where the opening/closing member closes the interior member. However, because the opening/closing member is by one pin, that is, only at one point, the opening/closing member wobbles, and there may be play at an engaging portion of the rod.

The object of the present invention is to provide an opening/closing body locking device that is capable of reducing a noise generated when an opening portion of a stationary body is closed, and capable of reducing play between a pair of locking portions and hook portions engaging the locking portions.

Means for Solving the Problem

In order to achieve the above-described object, the present invention provides an opening/closing body locking device for an opening/closing body that is openably/closably mounted to an opening portion of a stationary body, the locking device including:

locking portions provided on one of both lateral sides of the opening/closing body and both lateral sides of the opening portion of the stationary body;

a pair of link rods that are mounted to the other one of the opening/closing body and the stationary body, and are interlocked with each other to slidably move so that hook portions at distal ends thereof engage and disengage the locking portions;

a biasing unit that biases the hook portions of the link rods in directions that the hook portions engage the locking portions;

an operating member that causes the hook portions of the link rods to slide in directions that the hook portions disengage the locking portions against biasing force of the biasing unit;

pressing members that are provided on the both lateral sides of the opening portion of the stationary body or the both lateral sides of the opening/closing body, and press the opening/closing body in a direction to open the opening/closing body in a state where the hook portions engage the locking portions while the opening/closing body closes the opening portion; and a holding unit that holds the hook portions in a state where the hook portions disengage the locking portions against the biasing force of the biasing unit after the hook portions of the link rods are slid in the directions to disengage the locking portions by operating the operating member, and releases the holding of the hook portions to make the hook portions engage the locking portions when the opening/closing body is closed.

There may be configured the opening/closing body locking device, wherein, in a state where the hook portions engage the locking portions while the opening/closing body closes the opening portion of the stationary body, the hook portions and the pressing members are disposed at opposite positions sandwiching the locking portions.

There may be configured the opening/closing body locking device, wherein the locking portions having a pin shape are provided to the opening/closing body, wherein the stationary body includes concave portions that receive the locking portions, wherein the pressing members are disposed on the stationary body, wherein the link rods are provided to the stationary body and are biased inward such that the hook portions approach each other, and wherein, when the opening/closing body is closed, the hook portions block the concave portions to thereby retain the locking portions.

There may be configured the opening/closing body locking device, wherein the locking portions are provided on the both lateral sides of the opening portion of the stationary body, and wherein the pair of link rods are mounted to the opening/closing body, and are biased by the biasing unit such that the hook portions protrude outward.

There may be configured the opening/closing body locking device, wherein, when the hook portions of the link rods are slid in the directions to disengage the locking portions by operating the operating member, the holding unit is interlocked with at least the pressing member provided on one lateral side among the pressing members provided on the both lateral sides of the opening portion of the stationary body or the both lateral sides of the opening/closing body, and is moved by the biasing force of the pressing member to engage the link rod to thereby hold the hook portion in a state where the hook portion disengages the locking portion, while when the opening/closing body is closed to press the pressing member, the engagement of the holding unit with the link rod is released to thereby release the holding of the hook portion.

There may be configured the opening/closing body locking device, wherein the holding unit is provided on the both lateral sides of the opening portion of the stationary body or the both lateral sides of the opening/closing body so as to be interlocked with the pressing members provided also on the both lateral sides of the opening portion of the stationary body or the both lateral sides of the opening/closing body.

There may be configured the opening/closing body locking device, wherein the operating member is provided to the opening/closing body so as to be pushable while the pair of link rods are mounted to the opening/closing body so as to be slidable, so that the pair of link rods slide in directions that the hook portions disengage the locking portions against the biasing force of the biasing unit by pushing the operating member, wherein the holding unit includes a holding member that engages and disengages at least one of the link rods, wherein the holding member is integrated or interlocked with the pressing member, and wherein, when the operating member is pushed, the opening/closing body is pressed in the closing direction while the pressing member is pressed, whereby the holding member moves in a direction that the holding member disengages the link rod.

There may be configured the opening/closing body locking device, wherein the opening/closing body includes a lever that is mounted to the opening/closing body so as to be rotatable via a supporting shaft, wherein the pressing member is provided to one end portion of the lever, and wherein the holding member of the holding unit is provided to the other end portion of the lever so as to be engageable and disengageable with at least one of the link rods.

There may be configured the opening/closing body locking device, wherein the holding member of the holding unit is elastically deformable.

Advantageous Effects of Invention

According to the present invention, the opening/closing body is pressed in the direction to open the opening/closing body by the pressing members on the both lateral sides of the opening portion of the stationary body or the both lateral sides of the opening/closing body in a state where the opening/closing body closes the opening portion of the stationary body, and the hook portions of the pair of the link rods engage the locking portions on the both lateral sides of the opening/closing body or the both lateral sides of the opening portion of the stationary body. Thus, the hook portions and the locking portions that are disposed on the both lateral sides of the opening/closing body and the both lateral sides of the opening portion of the stationary body can be brought into contact with each other in a uniformly balanced manner without play, which can prevent an unusual sound from being made by vibration and the like of vehicles.

By sliding the hook portions of the link rods in the direction that the hook portions disengage the locking portions against the biasing force of the biasing unit by operating the operating member in a state where the opening/closing body is closed and the hook portions engage the locking portions, the engagement between the hook portions and the locking portions is released to allow the opening/closing body to be opened. At this time, the hook portions are held in a state where the hook portions disengage the locking portions by the holding unit.

Then, when the opening/closing body is closed again, the holding of the hook portions by the holding unit is released to slide the pair of link rods, and the hook portions engage the locking portions. Thus, the opening/closing body is held in the closed state.

As described above, the opening/closing body locking device is configured such that the holding unit is released upon closure of the opening/closing body, and then, the hook portions engage the locking portions. Thus, the opening/closing body can be closed more smoothly while a hitting noise generated upon closure of the opening/closing body can be reduced as compared with the conventional locking device in which the tapered portions at the distal ends of the hook portions are brought into contact with the locking portions and slide to be locked by the locking portions.

BRIEF DESCRIPTION OF THE DRAWINGS

FIG. 15 Views of the hook portion showing the operation of the locking device when closing the opening/closing body.

MODE FOR CARRYING OUT THE INVENTION

Hereinafter, an opening/closing body locking device according to the first embodiment of the present invention will be described referring to FIGS. 1 to 15.

Figure 1:
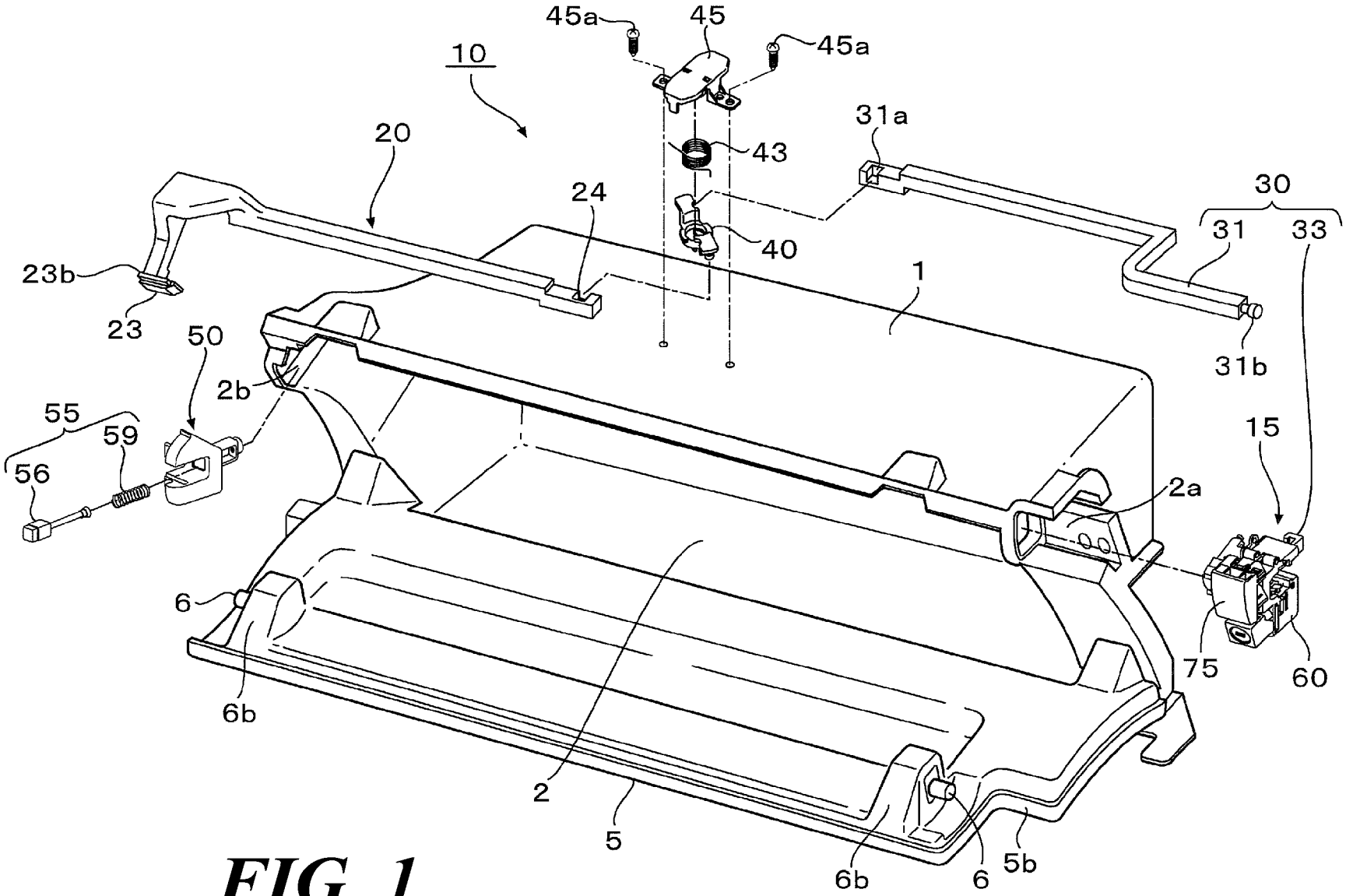
FIG. 1 An exploded perspective view of an opening/closing body locking device according to the first embodiment of the present invention.

As shown in FIG. 1, an opening/closing body locking device 10 (hereinafter, referred to as the "locking device 10") according to the present embodiment of the present invention is used to lock a lid 5 (the "opening/closing body" in the present invention) that is openably/closably mounted to an opening portion 2 of a glove box 1 (the "stationary body" in the present invention) formed in an instrument panel of a vehicle to regulate its opening/closing movement.

The glove box 1 includes mounting concave portions 2*a*, 2*b* provided at upper portions on the both lateral sides thereof. On the other hand, the lid 5 includes a notch 5*b* provided at the upper portion on one lateral side thereof corresponding to the mounting concave portion 2*a* of the glove box 1. Pin-shaped locking portions 6, 6 protrude from the upper portions on the both lateral sides of the lid 5 toward the outside thereof via wall portions 6*b* that bulge inward.

The locking device 10 according to the present embodiment includes a pair of link rods 20, 30 that are interlocked with each other to slidably move via a rotor 40, and a torsional spring 43 (the "biasing unit" in the present invention) that biases the link rods 20, 30 in directions that the link rods 20, 30 engage the locking portions 6, 6.

The link rod 20 has a letter-L bent shape on its distal end side, and includes a hook portion 23 having a plate shape and protruding inward protruding inward. The hook portion 23 has a tapered shape on the outer surface at the distal end, and includes guiding ribs 23*b*, 23*b* on the both sides. A coupling concave portion 24 for coupling with the rotor 40 is provided to the link rod 20 on the base end side.

The link rod 30 includes a rod 31 and a slider 33 coupled to the distal end of the rod 31. The rod 31 is bent in the middle of the axial direction, and its distal end extends parallel to the base end. The rod 31 includes a coupling concave portion 31*a* for coupling with the rotor 40 on the base end side, and includes a coupling pin 31*b* protruding at the distal end.

Figure 2:
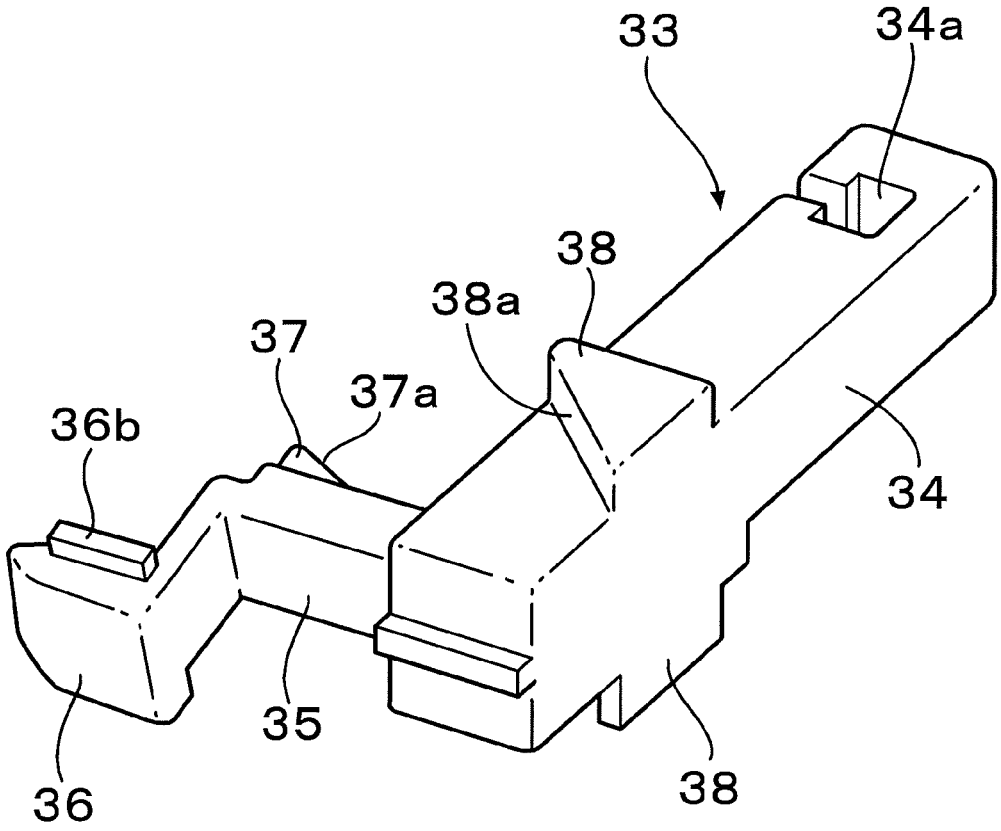
FIG. 2 A perspective view of a slider constituting the locking device.

The slider 33 includes a base portion 34 having a square pillar shape, an extending portion 35 having the letter-L shape that extends inward from a lateral surface at the distal end of the base portion 34, and a hook portion 36 having a plate shape that extends from the distal end of the extending portion 35 so as to be orthogonal to the central axis of the base portion 34 as shown in FIG. 2. The hook portion 36 has a tapered shape on the outer surface at the distal end, and includes guiding ribs 36*b*, 36*b* on the both sides. A holding protruding portion 37 including a slant face 37*a* protrudes on one lateral surface of the extending portion 35. A coupling concave portion 34*a* is provided to the base portion 34 on the lateral surface at the base end. The coupling pin 31*b* of the rod 31 engages the coupling concave portion 34*a* to couple the slider 33 to the rod 31. The link rod 30 is thus configured (see FIG. 1). Receiving portions 38, 38 including a slant face 38*a* protrude from the base portion 34 on both the upper and lower surfaces closer to the distal end.

Figure 3:
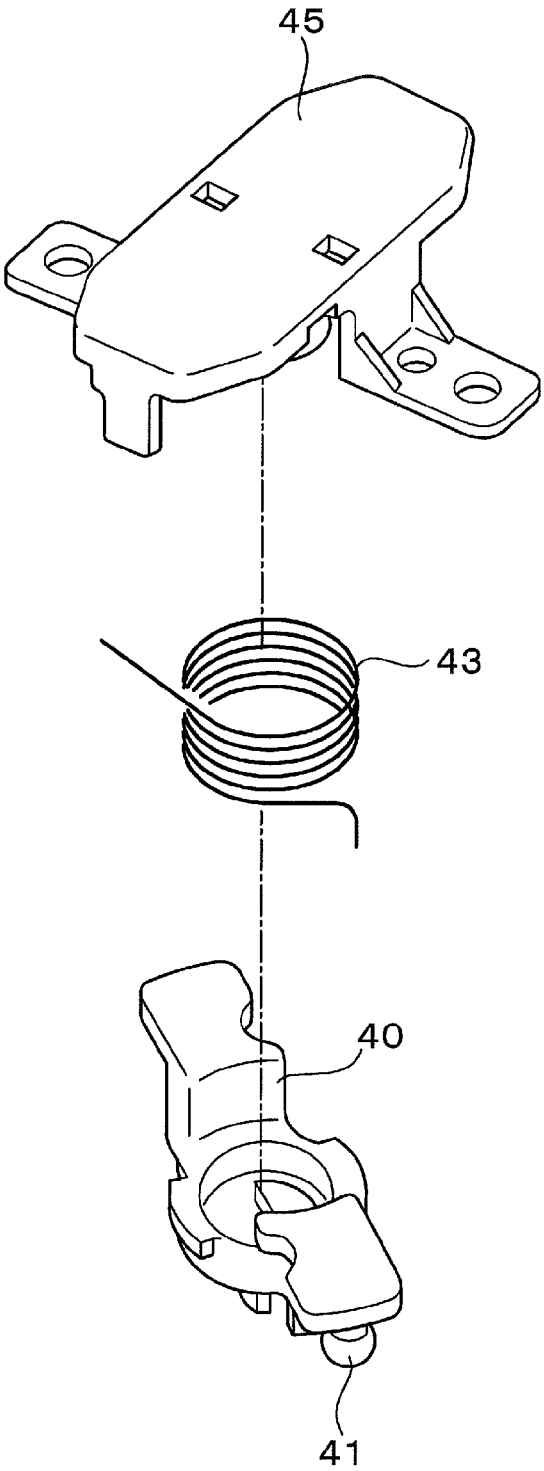
FIG. 3 A perspective view of a rotor, a biasing unit, and a pressing member constituting the locking device.

The above-described link rods 20, 30 are coupled to the rotor 40 shown in FIG. 3. The rotor 40 includes coupling pins 41, 41 protruding at both the end portions. The coupling pins 41, 41 fit the coupling concave portions 24, 31*a* of the link rods 20, 30 in an attachable and detachable manner. Thus, the base ends of the link rods 20, 30 are pivotally mounted at positions symmetric with respect to the rotor 40 (see FIG. 9). The torsional spring 43 is attached to the rotor 40, and the rotor 40 is mounted to the glove box 1 on the upper outer surface with screws 45*a* via a covering member 45 (see FIG. 1). This rotor 40 allows the link rods 20, 30 to be held on an upper surface side of the glove box 1 so as to be slidable along the width direction of the glove box 1 (the width direction of the horizontally long opening portion 2). The rotor 40 is rotatably biased by the torsional spring 43, and the hook portions 23, 36 of the link rods 20, 30 are biased toward the inside of the glove box in the direction to engage the locking portions 6, 6 on the both lateral sides of the lid, that is, biased such that the hook portions 23, 36 approach each other (see the arrows A in FIG. 9).

Figure 4:
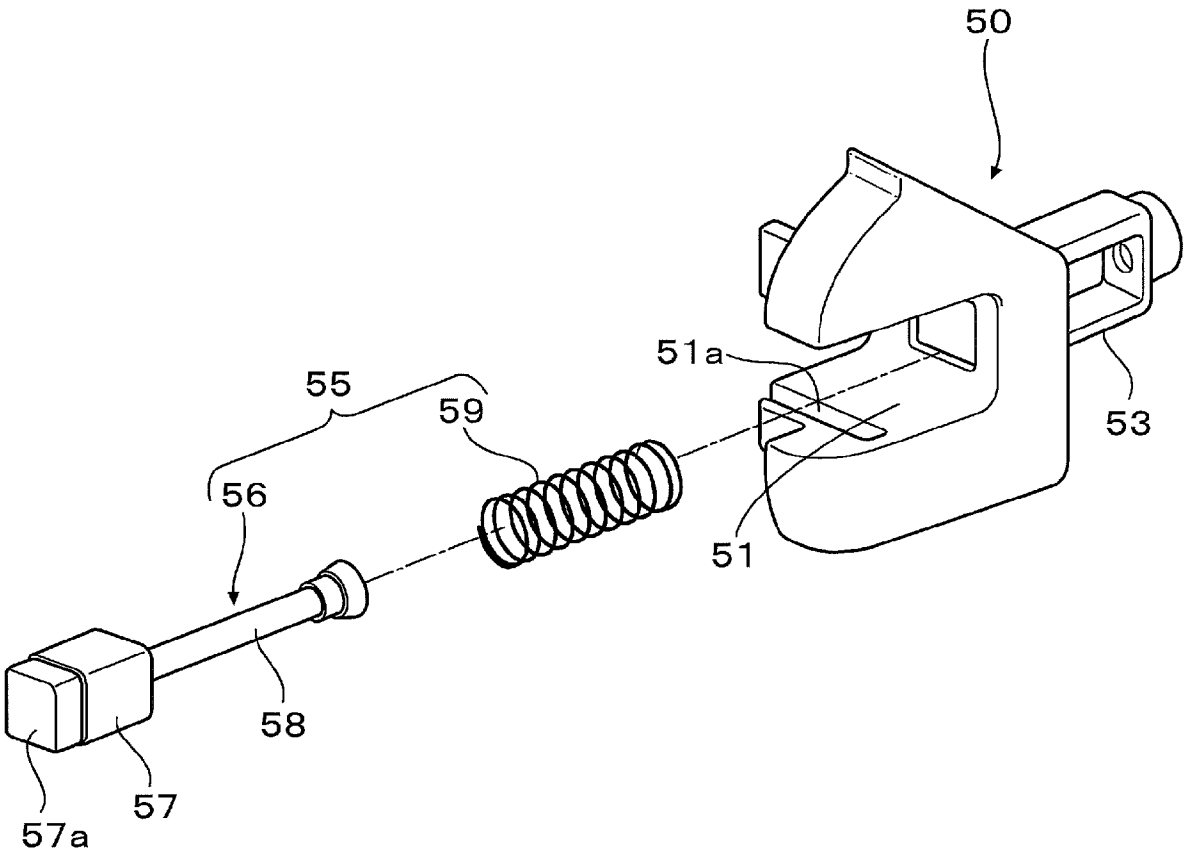
FIG. 4 A perspective view of a bezel and a pressing member constituting the locking device.

A bezel 50 is mounted to the mounting concave portion 2*b* of the glove box 1 as shown in FIG. 1. As shown in FIG. 4, the bezel 50 is open on the front side and the both lateral sides, and includes a concave portion 51 arranged to receive the pin-shaped locking portion 6 of the lid 5 when the lid 5 is closed to the opening portion 2 of the glove box 1, and a holding portion 53 having a frame shape that communicates with concave portion 51. On the inner surface of the front opening side of the concave portion 51, guiding grooves 51*a*, 51*a* are provided so as to guide the guiding ribs 23*b*, 23*b* of the hook portion 23 of the link rod 20. The guiding grooves 51*a*, 51*a* slidably hold the hook 23.

The holding portion 53 holds a pressing member 55 including a pressing pin 56 and a coil spring 59. The pressing pin 56 includes a base portion 57, to a front surface of which an elastic member 57*a* made from rubber, sponge or the like is fixed, and a pillar portion 58 extending from a back surface of the base portion 57. In a state where the base portion 57 is disposed inside the concave portion 51 while the pillar portion 58 is disposed inside the holding portion 53, the coil spring 59 is provided around the outer periphery of the pillar portion 58 to bias the pressing pin 56 toward the front of bezel. Thus, the locking portion 6 of the lid 5 is pressed in the direction to open the lid 5 (see the arrows B in FIG. 9) in a state where the hook portion 23 of the link rod 20 engages the locking portion 6, and the lid 5 is closed to the opening portion 2 of the glove box 1. In this state, the hook portion 23 and the pressing member 55 are disposed at opposite positions sandwiching the locking portion 6.

Figure 5:
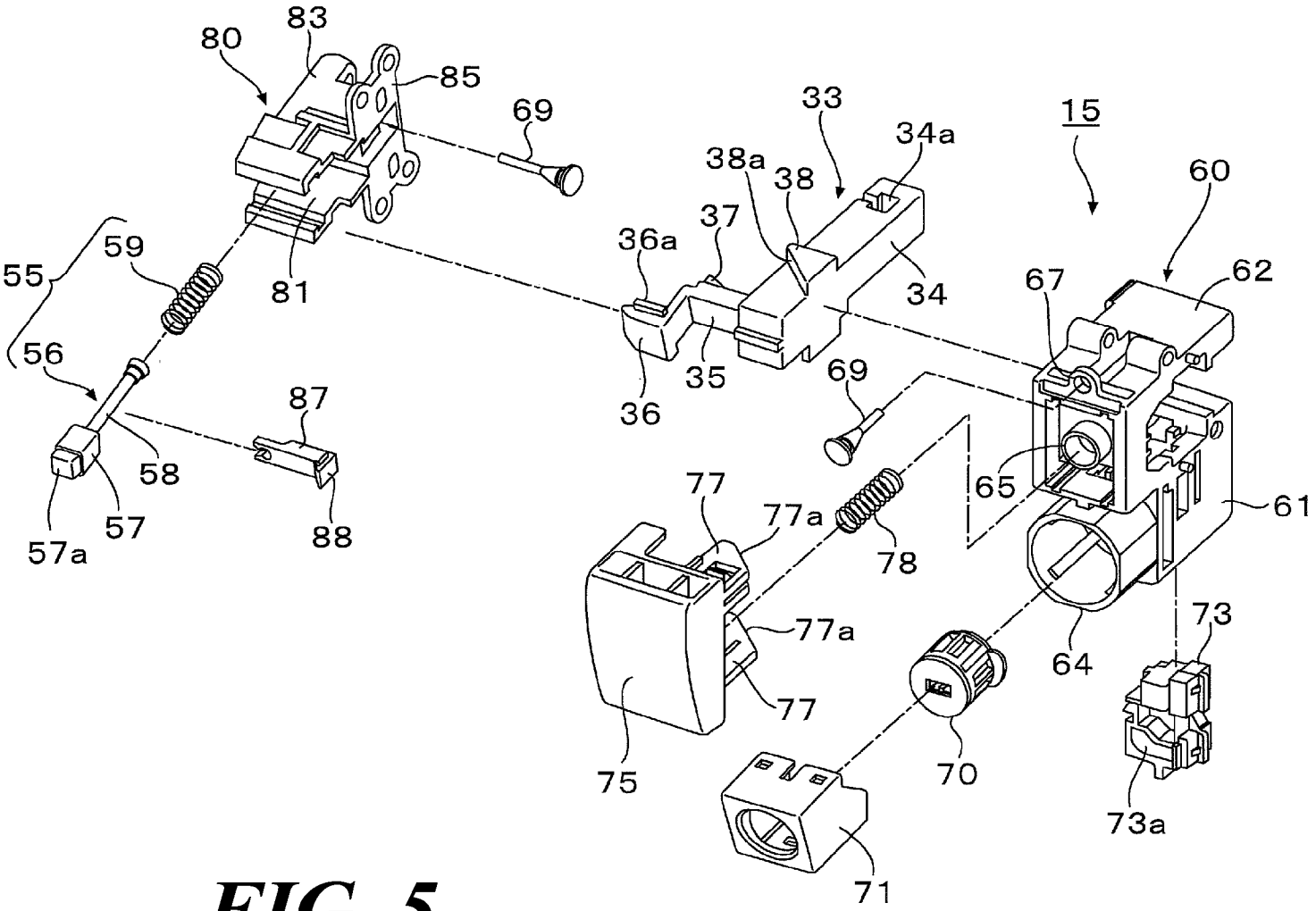
FIG. 5 An exploded perspective view of a locking assembly constituting the locking device.
Figure 8:
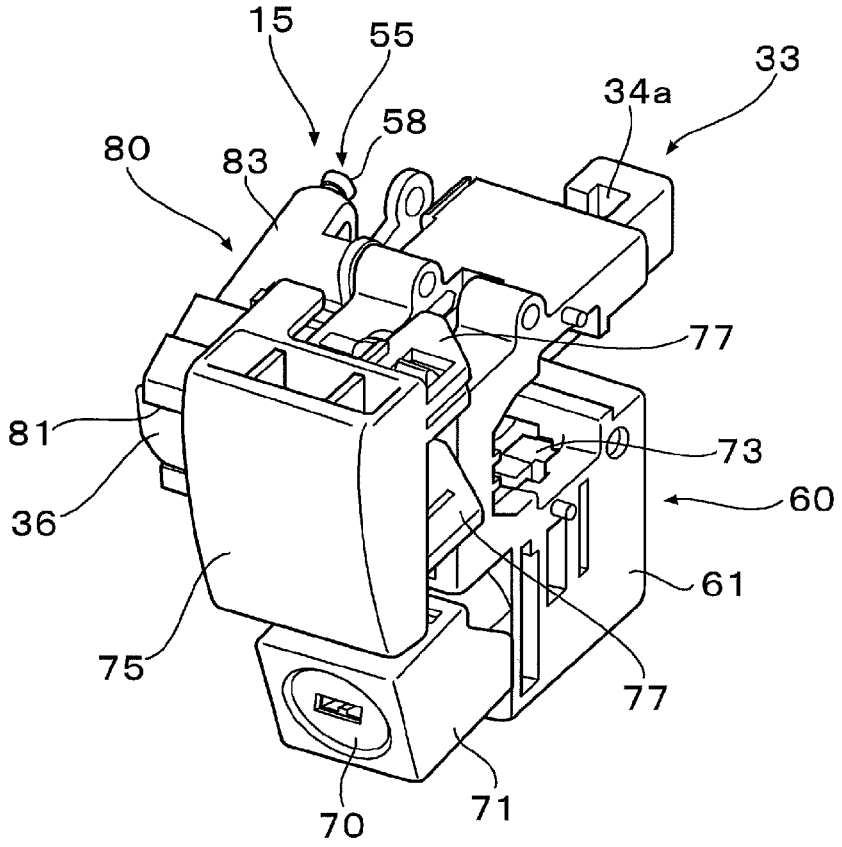
FIG. 8 A perspective view of the locking assembly constituting the locking device.

A locking assembly 15 including plural constructional members is mounted to the mounting concave portion 2*a* of the glove box 1 (see FIG. 1). As shown in FIG. 5 and FIG. 8, the locking assembly 15 mainly includes a housing 60, a key cylinder 70, a cover 71, a striker 73, a pusher 75, a holder 80, the above-described slider 33 that is a part of the link rod 30, and the pressing member 55.

Figure 6:
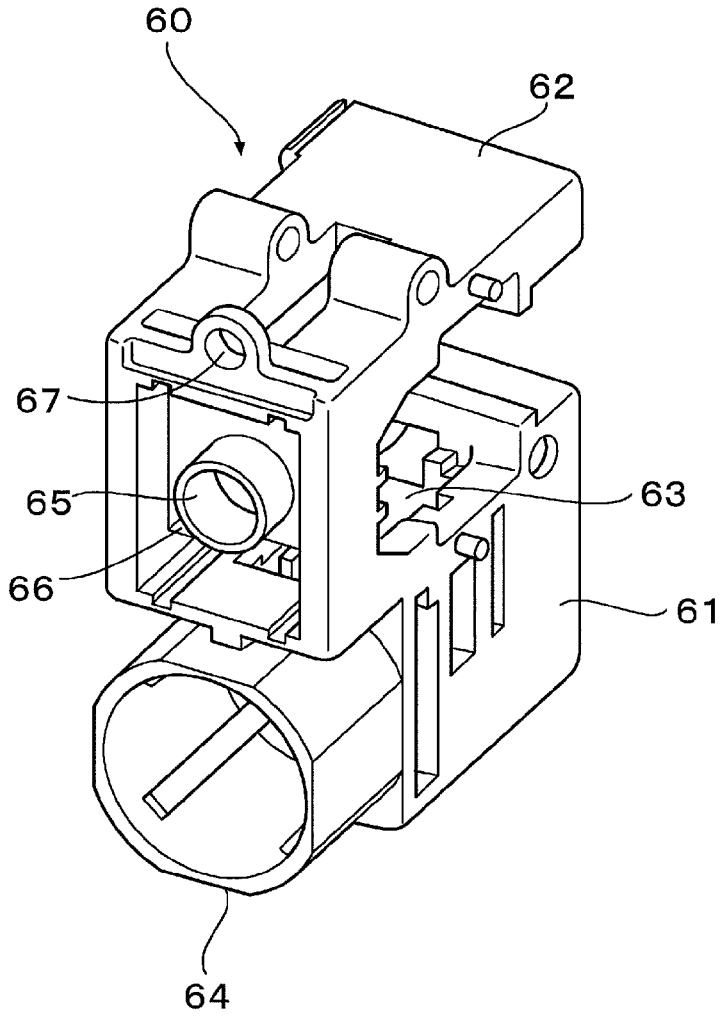
FIG. 6 A perspective view of a housing constituting the locking device.

Referring also to FIG. 6, the housing 60 mainly includes a box-shaped key placement portion 61 that houses the key cylinder 70 and the striker 73, and a frame-shaped slider holding portion 62 that is disposed adjacently above the key placement portion 61 and holds the pusher 75 and the slider 33.

The above-described key placement portion 61 includes a striker passage 63 in the up/down direction. The striker 73 is disposed in the key placement portion 61 so as to be slidable in the up/down direction. A key housing tube 64 protrudes from the front surface of the key placement portion 61 to house the key cylinder 70 rotatably. The cover 71 (see FIG. 5) is attached to the outer periphery of the key housing tube 64. When a key (not illustrated) is inserted into a key groove of the key cylinder 70 to be turned, a pin (not illustrated) protruding behind the key cylinder 70 slides a sliding concave portion 73*a* (see FIG. 5) of the striker 73 to slide the striker 73 in the up/down direction to make the striker 73 engage and disengage the lower surface of the slider 33. Thus, the sliding movement of the slider 33 is locked, or the locking is released.

The slider holding portion 62 has a letter-U frame shape that is open on the both lateral sides and the back side. The slider 33 is held by the slider holding portion 62 on the inner periphery so as to be slidable along the width direction of the glove box 1. A spring holding tube 65 protrudes from the front surface of this slider holding portion 62. A pair of slits 66, 66 are provided to the slider holding portion 62 above and below the spring holding tube 65 so as to communicate with the interior of the U-shaped frame. A cushion mounting hole 67 is provided to the slider holding portion 62 in the middle of the upper portion. A cushion 69 (see FIG. 5) made from rubber or the like is mounted to the cushion mounting hole 67 so as to move toward and away from the below-described pusher 75.

The pusher 75 (the "operating member" in the present invention) is retained in front of the slider holding portion 62 so as to be pushable in the direction orthogonal to the sliding direction of the slider 33. Pressing ribs 77, 77 having a plate shape that are inserted into the above-described slits 66, 66 protrude from the back surface of the pusher 75. Each pressing rib 77 includes a slant face 77*a* on its distal end, the slant face 77*a* being brought into slidable contact with the slant face 38*a* of the receiving portion 38 of the slider 33 (see FIG. 2). One end of a coil spring 78 is held by the spring holding tube 65 while the other end is held by the pusher 75 on the back side, and thereby the pusher 75 is biased in a direction away from the front surface of the slider holding portion 62.

When the pusher 75 is pushed against the biasing force of the coil spring 78, the slant faces 77*a* of the pressing ribs 77 are brought into slidable contact with the slant faces 38*a* of the receiving portions 38 of the slider 33. Then, the link rod 30 is slid against the biasing force of the torsional spring 43 while the link rod 20 is slid via the rotor 40. Thus, the link rods 20, 30 are slid in directions that the hook portions 23, 36 of the link rods 20, 30 disengage the locking portions 6, 6 of the lid 5, that is, toward the outside of the glove box such that the hook portions 23, 36 move away from each other (see FIG. 9 and FIG. 10)

Figure 7:
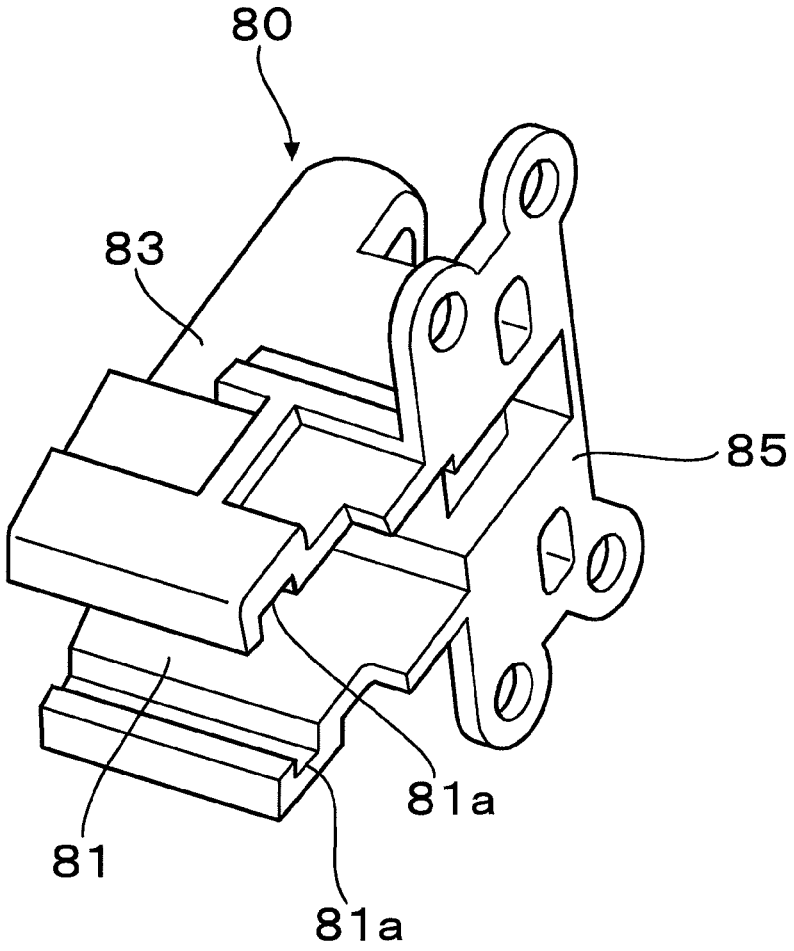
FIG. 7 A perspective view of a holder constituting the locking device.

The above-described holder 80 is mounted to the housing 60 on the lateral side. As shown in FIG. 7, the holder 80 is open on the front side and the both lateral sides, and includes a concave portion 81 arranged to receive the pin-shaped locking portion 6 of the lid 5 when the lid 5 is closed to the opening portion 2 of the glove box 1, a holding portion 83 having a frame shape that communicates with concave portion 81, and a mounting portion 85 with which the holder 80 is mounted to the housing 60. On the inner surface of the front opening side of the concave portion 81, guiding grooves 81*a*, 81*a* are provided so as to guide the guiding ribs 36*b*, 36*b* of the hook portion 36 of the link rod 30. The guiding rigs 36*b*, 36*b* slidably hold the hook 36. A cushion mounting hole (not illustrated) is provided on the lateral side of the holder 80. A cushion 69 (see FIG. 5) that moves toward and away from the above-described slider 33 is mounted to the cushion mounting hole.

The above-described holding portion 83 holds the pressing member 55 in a manner similar to the holding portion 53 of the above-described bezel 50. That is, according to the pressing member 55, the locking portion 6 of the lid 5 is pressed in the direction to open the lid 5 (see the arrow B in FIG. 9) in a state where the hook portion 36 of the link rod 30 engages the locking portion 6, and the lid 5 is closed to the opening portion 2 of the glove box 1. In this state, the hook portion 36 and the pressing member 55 are disposed at opposite positions sandwiching the locking portion 6.

A holding lever 87 is provided to the holder 80 (see FIG. 5). The holding lever 87 has a hook groove shape on the base end side, and is mounted orthogonal to the pillar portion 58 of the pressing pin 56 constituting the pressing member 55 (see FIG. 12 and FIG. 13). A distal end portion 88 of the holding lever 87 functions as a portion moving toward and away from the holding protruding portion 37 of the slider 33 (see FIGS. 9 to 11). A protruding portion 89 including a slant face 89*a* protrudes from one lateral surface of the distal end portion 88 of the holding lever 87 as shown in FIG. 13. The holding lever 87 is disposed such that the distal end portion 88 is disposed above the slant face 37*a* of the holding protruding portion 37 of the slider 33 in a state where the hook portion 36 of the link rod 30 is biased in the direction to engage the locking portion 6 (see FIG. 9 and FIG. 12).

Figure 12:
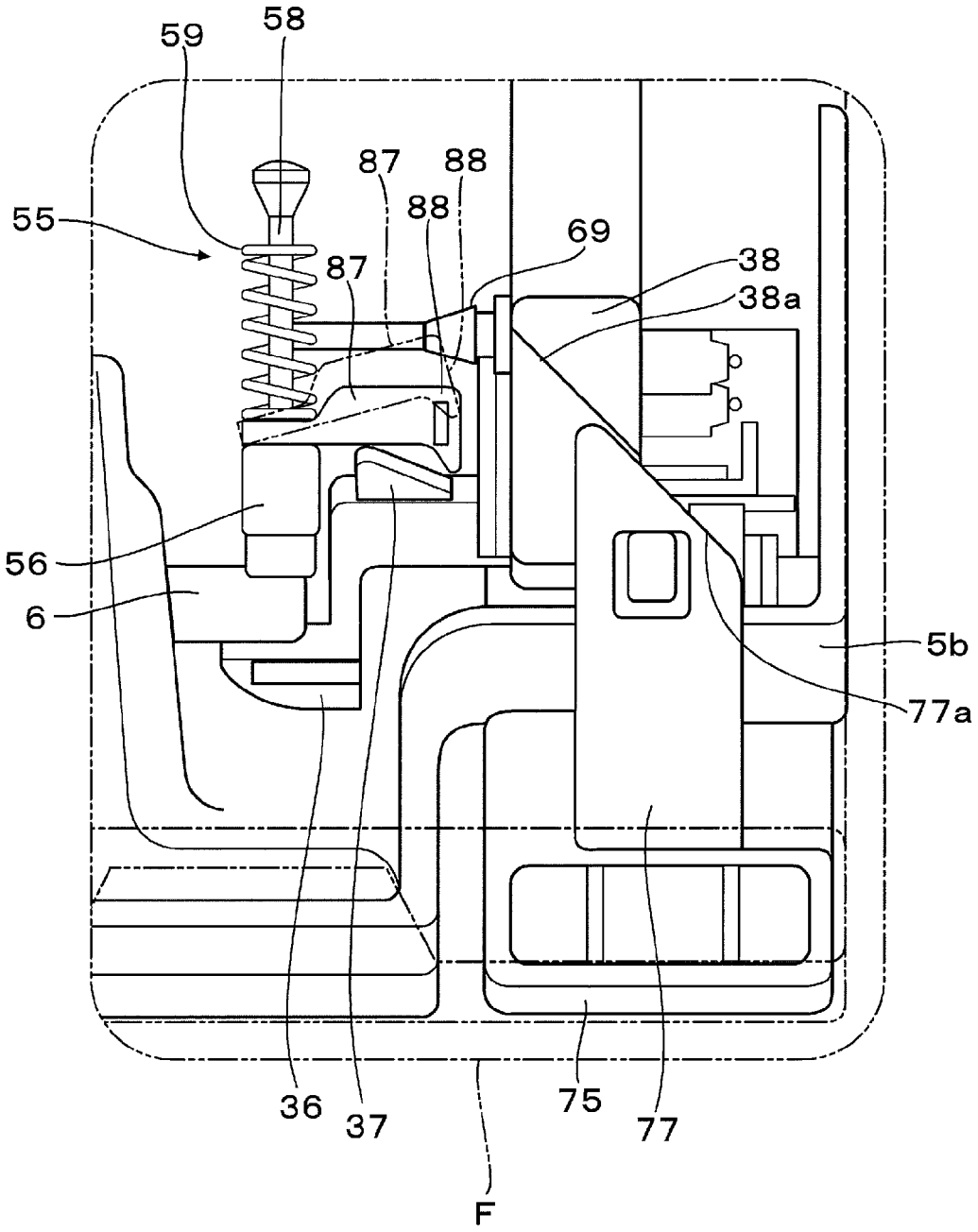
FIG. 12 An enlarged explanatory view of the portion surrounded by the alternate long and two short dashes line F in FIG. 9.
Figure 13:
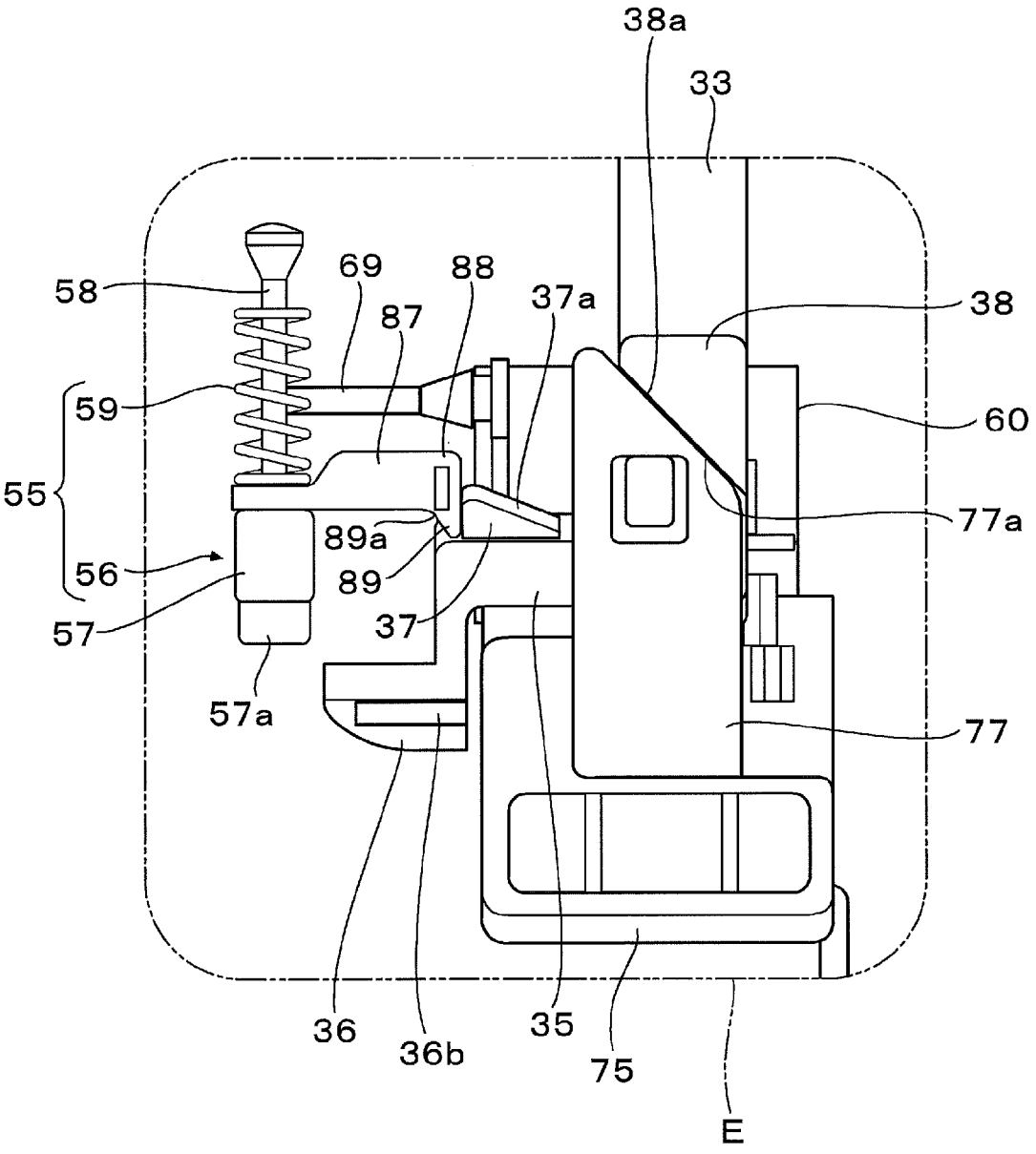
FIG. 13 An enlarged explanatory view of the portion surrounded by the alternate long and two short dashes line E in FIG. 11.

The holding lever 87 is arranged to, when the pusher 75 is pushed to slide the hook portion 36 in the direction to disengage the locking portion 6, and the holding lever 87 climbs over the holding protruding portion 37 of the slider 33, swing in a direction that the distal end portion 88 moves away from the holding protruding portion 37 with the base end side as a pivot center as indicated by the alternate long and two short dashes line in FIG. 12.

Figure 9:
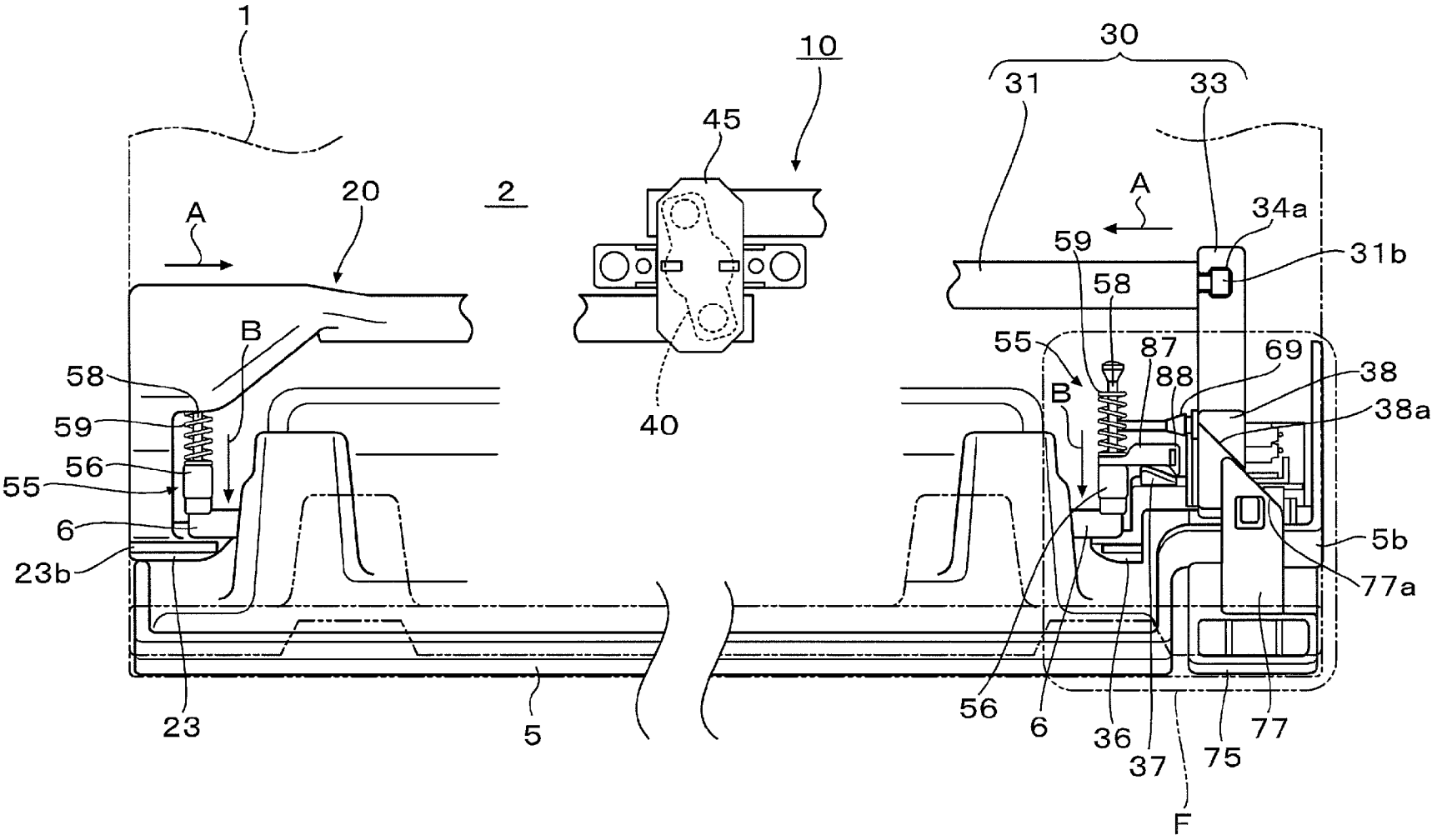
FIG. 9 An explanatory view of the locking device showing the operation where an opening/closing body is locked in a closed state with respect to an opening portion of a stationary body.

When the pusher 75 is pushed in a state where the hook portions 23, 36 engage the locking portions 6, 6 of the lid 5 as shown in FIG. 9, the hook portions 23, 36 of the link rods 20, 30 slide in the directions that the hook portions 23, 36 disengage the locking portions 6, 6. Then, as shown in FIG. 12, the holding protruding portion 37 of the slider 33 of the link rod 30 pushes the protruding portion 89 of the holding lever 87 against the biasing force of the coil spring 59 to move along the outside of the holding lever 87 while swinging the holding lever 87. Having climbed over the protruding portion 89 of the holding lever 87, the holding protruding portion 37 engages the end face of the distal end portion 88 of the holding lever 87 (see FIG. 13). As a result, the hook portion 36 is prevented from moving inward, and the pair of link rods 20, 30 are prevented from sliding inward despite the biasing force of the torsional spring 43. Thus, the hook portions 23, 36 are held in a state where the hook portions 23, 36 disengage the locking portions 6, 6.

Figure 14:
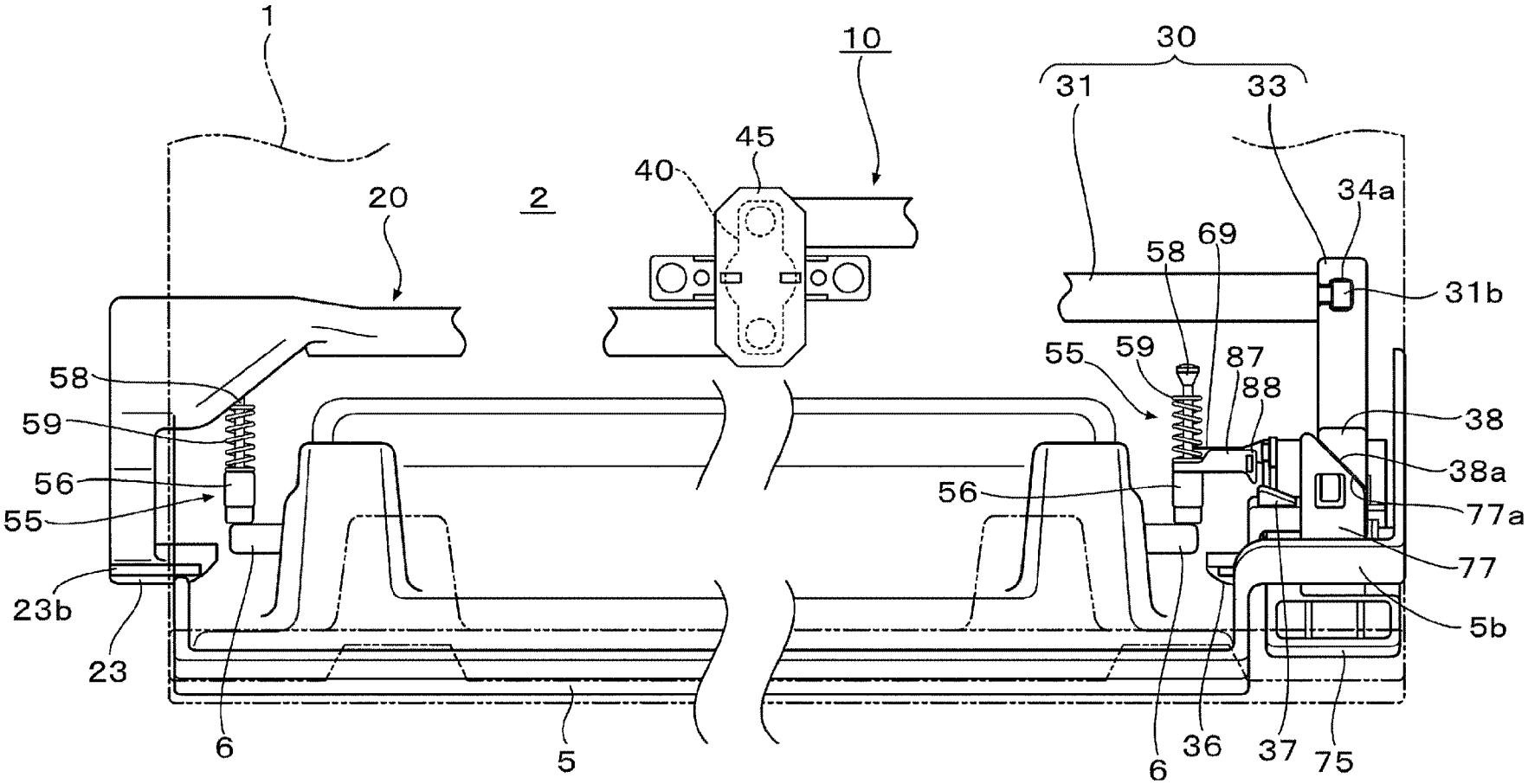
FIG. 14 An explanatory view of the locking device showing the operation where the opening/closing body is closed, and the holding state of the hook portions by the holding unit is released.
Figure 15A:
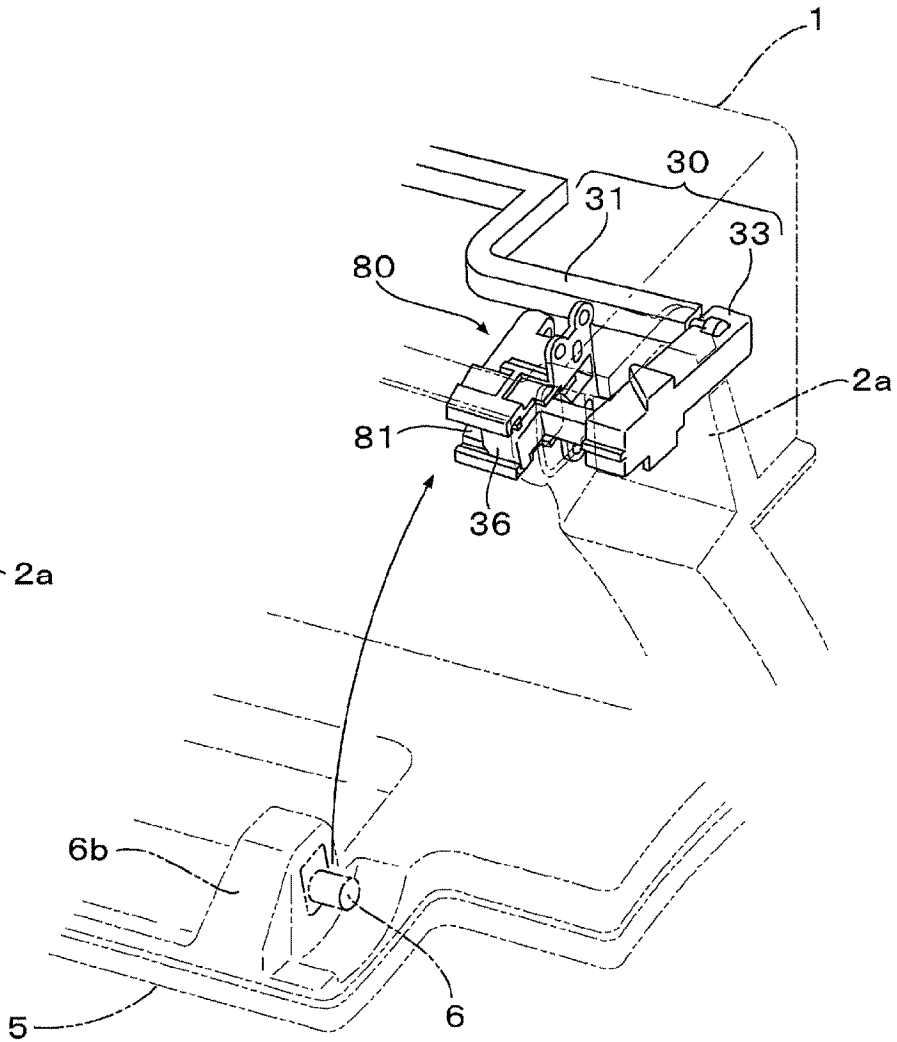
FIG. 15A is an enlarged perspective view of relevant components showing the state where the opening/closing body is yet to be closed.
Figure 15B:
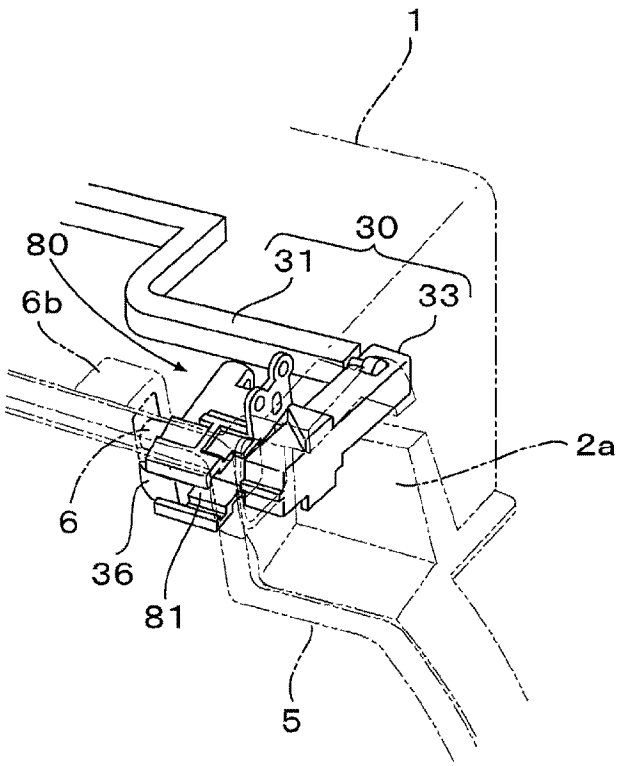
FIG. 15B is an enlarged perspective view of relevant components showing the state where the opening/closing body is closed, and the hook portion blocks the concave portion.

When the lid 5 is closed from this state, the locking portions 6, 6 respectively press the pressing members 55, 55 to release the engagement between the holding lever 87 and the holding protruding portion 37 to release the holding states of the hook portions 23, 36 as shown FIG. 14. Then, the biasing force of the torsional spring 43 makes the hook portions 23, 36 slide so as to close the concave portion 51 of the bezel 50 and the concave portion 81 of the holder 80 (see FIGS. 15A and 15B), and the hook portions 23, 36 engage again the locking portions 6, 6 (see FIG. 9).

Here, the holding lever 87 mounted to the pressing member 55 and the holding protruding portion 37 provided to the slider 33 of the link rod 3 function as the "holding unit" in the present invention. The housing 60, the pusher 75, and the like of the locking assembly 15 are not illustrated for the sake of illustration in FIGS. 15A and 15B.

Next, an operation and an effect of the locking device 10 including the above-described constructional members will be described.

First, because the housing 60, the key cylinder 70, the cover 71, the striker 73, the pusher 75, the holder 80, the slider 33 of the link rod 30 and the pressing member 55 are assembled into the locking assembly 15 as shown in FIG. 5 in the present embodiment, only mounting this locking assembly 15 to the mounting concave portion 2*a* of the glove box 1 (see FIG. 1) allows the plural constructional members to be easily mounted to the glove box 1. Thus, mounting workability can be improved.

In the locking device 10, the pressing pins 56, 56 of the pressing members 55, 55 respectively bias the locking portions 6, 6 of the lid 5 in the direction to open the lid 5 in a state where the hook portions 23, 36 of the link rods 20, 30 engage the pin-shaped locking portions 6, 6 of the lid 5, and the lid 5 is closed to the opening portion 2 of the glove box 1 as shown in FIG. 9. Thus, the hook portions 23, 36 and the locking portions 6, 6 can be brought into contact with each other without play at all times, which can effectively prevent an unusual sound from being made by vibration and the like of vehicles.

When the opening portion 2 of the glove box 1 is opened from the above-described state, the pusher 75 is pushed against the biasing force of the coil spring 78 (see FIG. 5). Then, the slant face 77*a* of each pressing rib 77 is brought into slidable contact with the slant face 38*a* of each receiving portion 38 of the slider 33. Then, the link rod 30 is slid against the biasing force of the torsional spring 43 (see FIG. 1) while the link rod 20 is slid via the rotor 40. Thus, the link rods 20, 30 are slid in directions that the hook portions 23, 36 disengage the locking portions 6, 6, which can move the lid 5 from the opening portion 2 of the glove box 1 to open the opening portion 2 (see FIG. 11).

Figure 10:
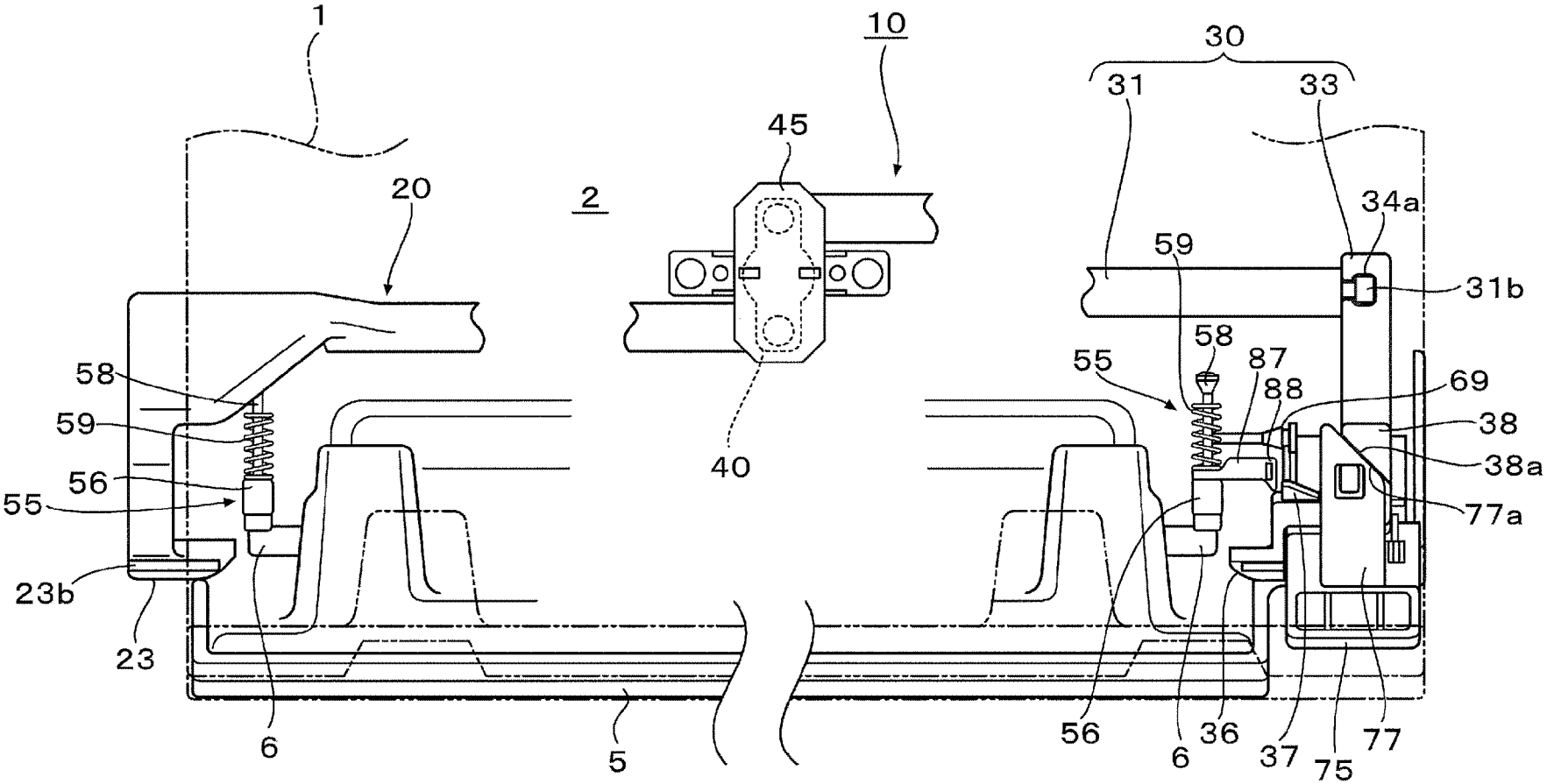
FIG. 10 An explanatory view of the locking device showing the operation where the locking state is released by the operating member.
Figure 11:
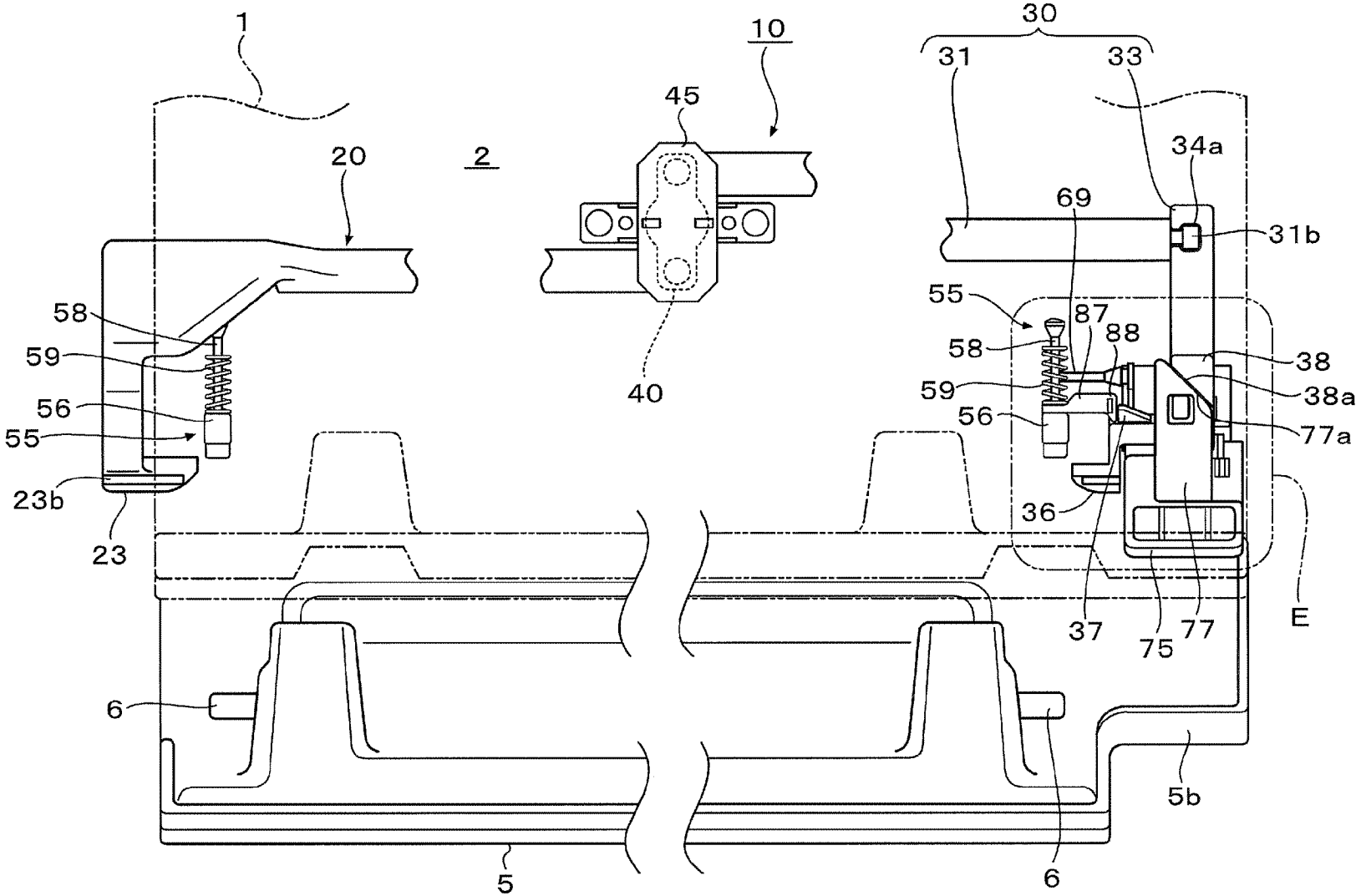
FIG. 11 An explanatory view of the locking device showing the operation where the hook portions are held in a state where the hook portions disengage the locking portions by the holding unit.

When the hook portions 23, 36 are slid in the directions to disengage the locking portions 6, 6 as described above, the holding protruding portion 37 of the slider 33 of the link rod 30 pushes the protruding portion 89 of the holding lever 87 against the biasing force of the coil spring 59 as shown in FIG. 12 to move along the outside of the holding lever 87 while swinging the holding lever 87 (see FIG. 10). Having climbed over the protruding portion 89 of the holding lever 87, the holding protruding portion 37 engages the end face of the distal end portion 88 of the holding lever 87 (see FIG.

13). As a result, the hook portion 36 is prevented from moving inward, and the pair of link rods 20, 30 are prevented from sliding inward despite the biasing force of the torsional spring 43. Thus, the hook portions 23, 36 are held in a state where the hook portions 23, 36 disengage the locking portions 6, 6 (see FIG. 11).

Then, by moving the lid 5 in the direction to close the opening portion 2 of the glove box 1, the locking portions 6, 6 of the lid 5 enter into the concave portion 51 of the bezel 50 (see FIG. 4) and the concave portion 81 of the holder 80 constituting the locking assembly 15 (see FIG. 7) that are disposed on the both lateral sides of the opening portion, and the locking portions 6, 6 respectively press the pressing pins 56, 56 against the biasing force of the coil springs 59 (see FIG. 14). Thus, the distal end portion 88 of the holding lever 87 moves away from the holding protruding portion 37 of the slider 33 of the link rod 30 to thereby release the engaging state between the holding lever 87 and the holding protruding portion 37, that is, the holding states of the hook portions 23, 36. As a result, the hook portions 23, 36 of the link rods 20, 30 move in the direction to approach each other by the biasing force of the torsional spring 43. The hook portion 23 is slid so as to block the concave portion 51 of the bezel 50 while the hook portion 36 is slid so as to block the concave portion 81 of the holder 80. Thus, the hook portions 23, 36 engage so as to retain the locking portions 6, 6, to thereby lock the lid 5 in a closed state with respect to the opening portion 2 of the glove box 1 (see FIG. 9 and FIG. 15B).

As described above, in this locking device 10, when the lid 5 is opened from the opening portion 2, the holding unit including the holding lever 87 and the holding protruding portion 37 of the slider 33 holds the hook portions 23, 36 in a state where the hook portions 23, 36 disengage the locking portions 6, 6, and when the lid 5 is closed to the opening portion 2, the holding unit is released to make the hook portions 23, 36 engage the locking portions 6, 6. Thus, the lid 5 can be closed smoothly with no resistance while a hitting noise generated upon closure of the lid 5 can be reduced.

In the present embodiment, when the hook portions 23, 36 engage the locking portions 6, 6 of the lid 5 to close the opening portion 2 of the glove box 1 with the lid 5, the hook portions 23, 36 and the pressing members 55, 55 are disposed at opposite positions sandwiching the locking portions 6, 6. Thus, the locking portions 6, 6 are sandwiched between the hook portions 23, 36 and the pressing members 55, 55 to make it easier to exert the pressure forces of the pressing members 55, 55 on the locking portions 6, 6, which can make the hook portions 23, 36 engage the locking portions 6, 6 firmly without play.

In the present embodiment, the pin-shaped locking portions 6, 6 are provided to the lid 5 while the link rods 20, 30, the pressing members 55, 55, and the concave portions 51, 81 arranged to receive the locking portions 6, 6 are provided to the glove box 1. When the lid 5 is closed to the opening portion 2, the locking portions 6, 6 get into the concave portion 51 of the bezel 50 and the concave portion 81 of the holder 80. Then, the holding unit is released, and the plate-shaped hook portions 23, 36 slide and retain the locking portions 6, 6 so as to close the front openings of the concave portions 51 and 81 (see FIGS. 15A and 15B). According to the present embodiment, it is essential only to provide the link rods 20, 30, and the pressing members 55, 55 to the glove box 1 while providing only the pin-shaped locking portions 6, 6 to the lid 5. Thus, the lid 5 can be reduced in thickness to enlarge the housing space while the appearance of the housing space when the lid 5 is opened can be enhanced.

In the present embodiment, the holding lever 87 constituting the holding unit is mounted to the pressing pin 56 of the pressing member 55 corresponding to the link rod 30 such that the holding unit is interlocked with the motion of the pressing member 55. Thus, the pressing member 55 and the holding unit can share constructional members, which can reduce the number of constructional members to achieve simplification of the structure.

Figure 16:
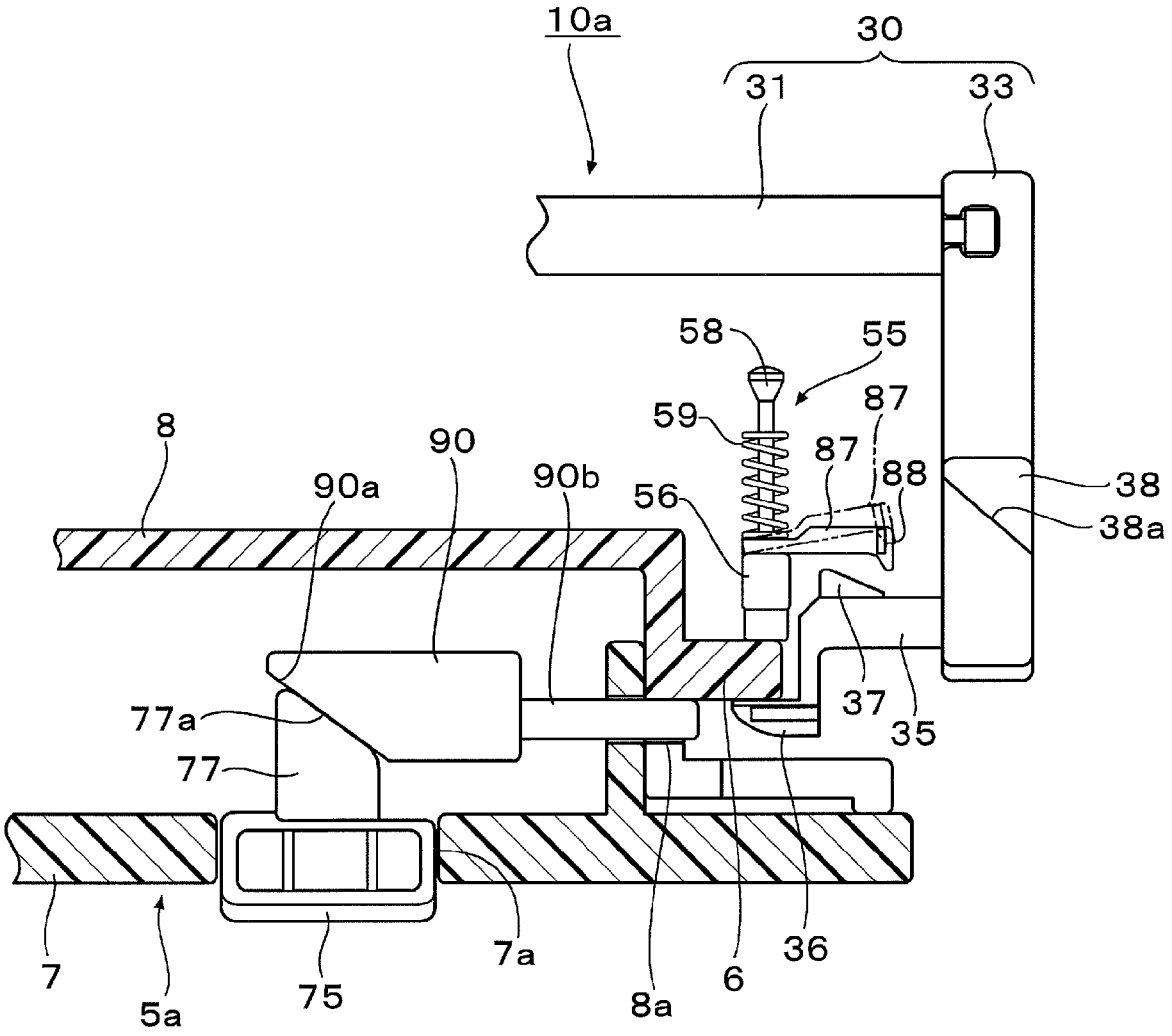
FIG. 16 An enlarged explanatory view of relevant components of an opening/closing body locking device according to the second embodiment of the present invention.

An opening/closing body locking device according to the second embodiment of the present invention is illustrated in FIG. 16. The same reference numerals are provided to the components that are substantially same as those in the above-described embodiment, and explanations of those components are omitted.

As shown in the enlarged explanatory view of relevant components of FIG. 16, an opening/closing body locking device 10*a* (hereinafter, referred to as the "locking device 10*a*") according to the present embodiment is different from the first embodiment in the position of the pusher 75.

A lid 5*a* according to the present embodiment includes a panel 7 including a pusher mounting hole 7*a*, and a box 8 fixed to the back surface side of the panel 7 and including a pass-through hole 8*a* provided at the lateral portion. The pusher 75 is retained so as to be pushable into the pusher mounting hole 7*a*. In the interior space of the lid 5*a*, a slider 90 is disposed so as to be slidable along the width direction of the lid 5*a*. The slider 90 includes one end surface that forms a slant face 90*a* and a pressing rod 90*b* protruding from the other end surface.

When the pusher 75 is pushed in a state where the lid 5*a* is closed to the opening portion 2 of the glove box 1, the slider 90 slides against the biasing force of the biasing unit (not illustrated) via the slant faces 77*a*, 90*a*. Then, the pressing rod 90*b* protruded from the pass-through hole 8*a* pushes the hook portion 36 of the link rod 30 outward to release the engagement between the hook portion 36 and the locking portion 6.

Figure 17:
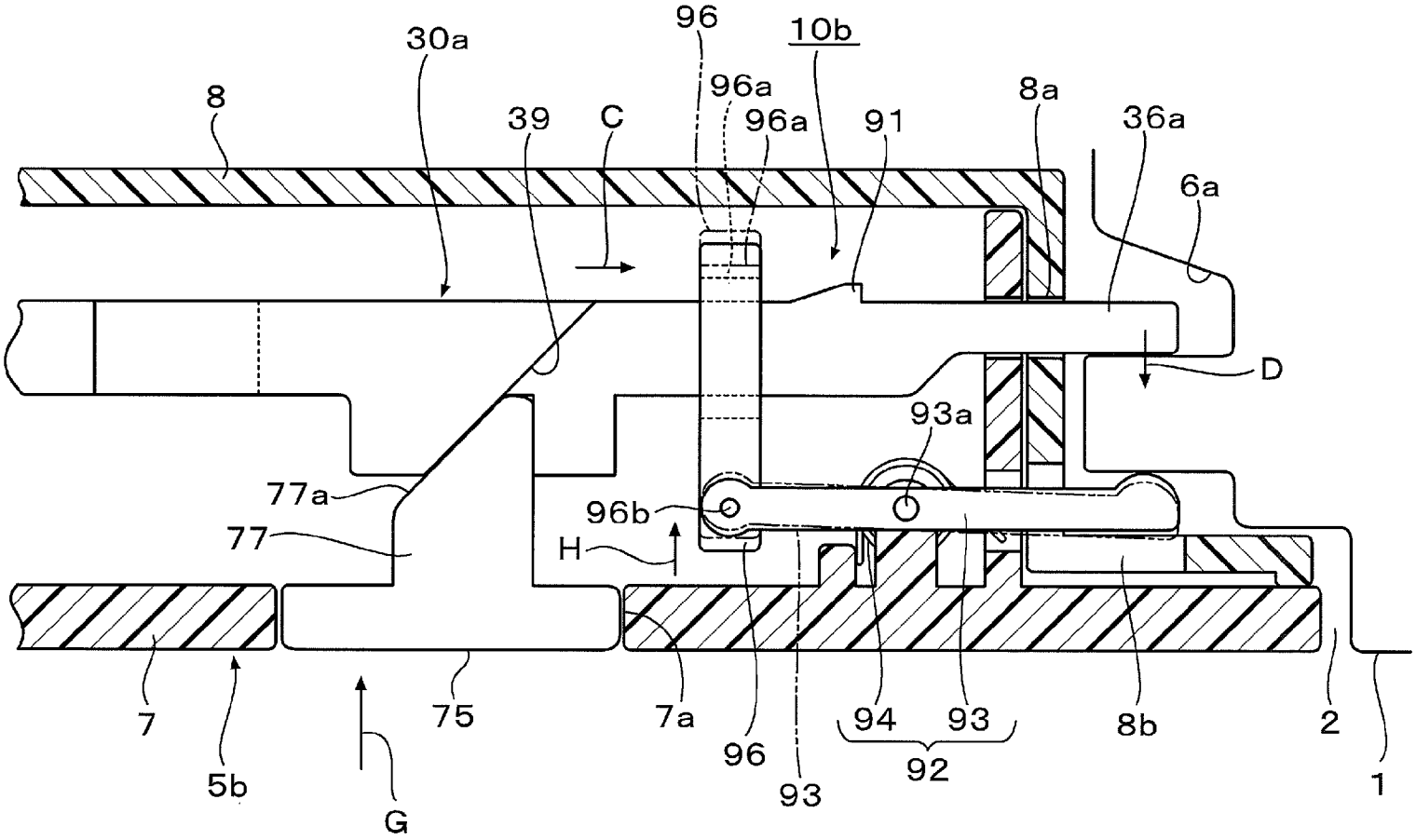
FIG. 17 An enlarged explanatory view of relevant components of an opening/closing body locking device according to the third embodiment of the present invention.
Figure 18:
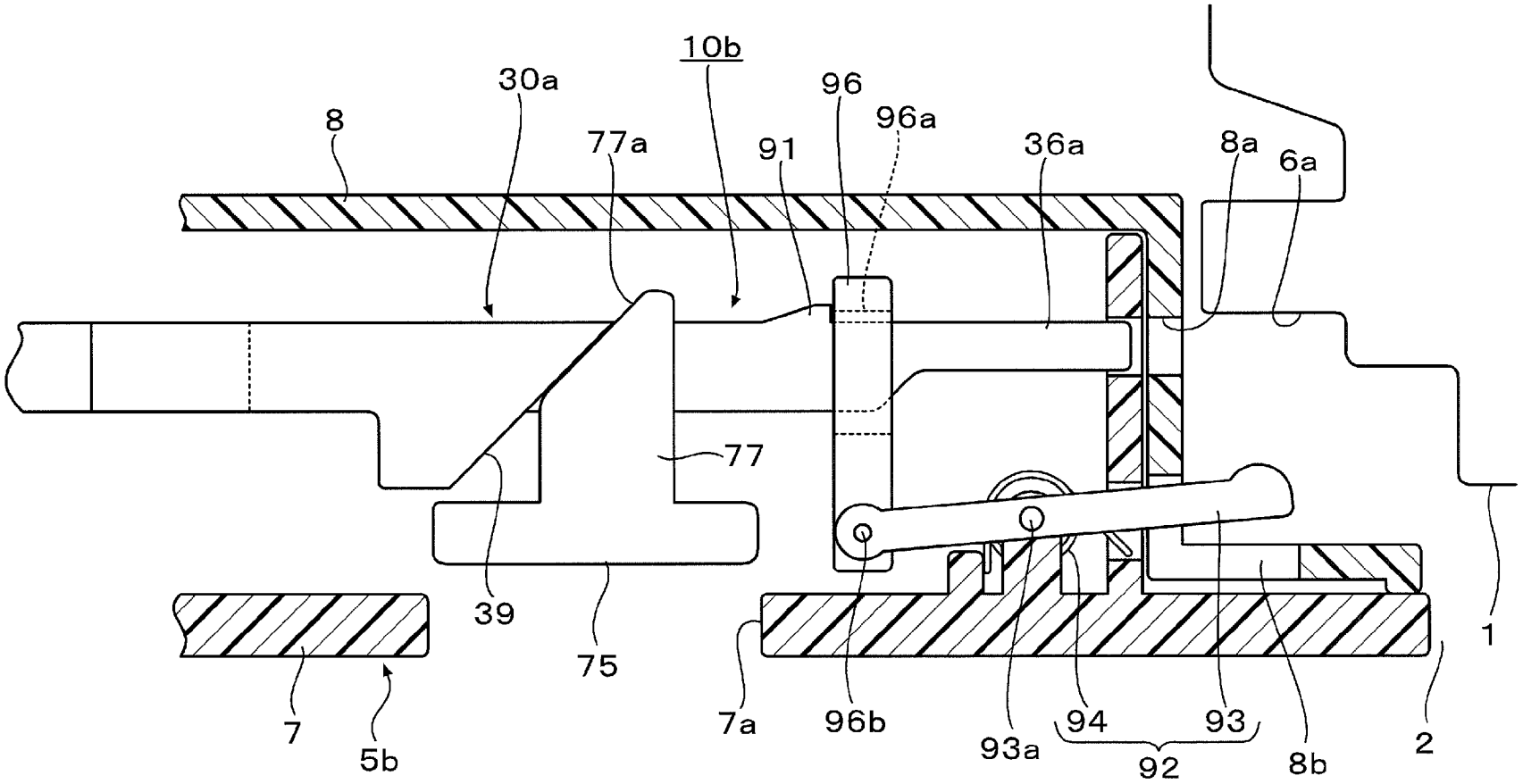
FIG. 18 An enlarged explanatory view of relevant components of the opening/closing body locking device according to the third embodiment of the present invention where the locking state of the opening/closing body is released.

An opening/closing body locking device according to the third embodiment of the present invention is illustrated in FIG. 17 and FIG. 18. The same reference numerals are provided to the components that are substantially same as those in the above-described embodiment, and explanations of those components are omitted.

As shown in the enlarged explanatory view of relevant components of FIG. 17, an opening/closing body locking device 10*b* (hereinafter, referred to as the "locking device 10*b*") according to the present embodiment is different from the above-described embodiments in that the locking portions are provided to the stationary body. To be specific, concave-shaped locking portions 6*a* are provided to the opening portion 2 of the glove box 1 at the both lateral sides on the inner surface.

The lid 5*b* according to the present embodiment includes a panel 7 including a pusher mounting hole 7*a*, and a box 8 fixed to the back surface side of the panel 7, a pass-through hole 8*a* provided at the lateral portion of the box 8 to allow a hook portion 36*a* of a link rod 30*a* pass therethrough, and a disposition hole 8*b* provided to the box 8 on the lateral surface toward the panel to allow a distal end of the pressing member to be disposed therein.

The pusher 75 (the "operating member" in the present invention) is retained so as to be pushable into the pusher mounting hole 7*a* of the above-described lid 5*b*. A pair of link rods (only one link rod 30*a* is illustrated while the other link rod is not illustrated in FIGS. 17 and 18 because FIGS. 17 and 18 are partially enlarged views) are mounted in the interior space of the lid 5*b* so as to slidably move outward or inward interlocked with each other. The hook portion 36*a* of the link rod 30*a* is biased toward the outside of the lid by a biasing unit (not illustrated) (see the arrow C in FIG. 17). A slant face 39 is provided to the link rod 30*a* in the middle of the axial direction, and a holding protruding portion 91 is provided to the link rod 30*a* so as to protrude on one lateral surface on the distal end side.

When the pusher 75 on the lid 5*b* is pushed (see the arrow G), the link rod 30*a* slides against the biasing force of the biasing unit (not illustrated) in a direction that the hook portion 36*a* disengages the locking portion 6*a* while the other link rod (not illustrated) is interlocked with the link rod 30*a* to slide in a direction that the hook portion of the other link rod disengages the locking portion 6*a*.

In the interior space of the lid 5*b*, a pressing arm 93 is held so as to be rotatable via a supporting shaft 93*a* in a state where the distal end of the pressing arm 93 is disposed in the disposition hole 8*b* while the distal end of the pressing arm 93 is biased toward the back side of the lid by a torsional spring 94. The pressing arm 93 and the torsional spring 94 constitute a pressing member 92.

A locking bar 96 having a rod shape and including an insertion hole 96*a* is provided while the distal end of the link rod 30*a* is inserted into the insertion hole 96*a*. One end of the locking bar 96 is coupled to the base end of the pressing arm 93 so as to be rotatable via a supporting shaft 96*b*. Thus, the locking bar 96 slidably moves in the direction approximately orthogonal to the link rod 30*a* in response to the rotational movement of the pressing arm 93 to thereby engage and disengage the holding protruding portion 91 of the link rod 30*a* (see FIG. 17 and FIG. 18). The locking bar 96 and the holding protruding portion 91 of the link rod 30*a* function as the "holding unit" in the present invention. The locking bar 96 functions as the "holding member" in the present invention. Because the locking bar 96 is coupled to the pressing arm 93 of the pressing member 92 so as to be rotatable as described above, the locking bar 96 is interlocked with the pressing arm 93.

In a state where the hook portion 36*a* of the link rod 30*a* engages the concave locking portion 6*a* of the opening portion 2 of the glove box 1, and the lid 5*a* is closed to the opening portion 2, the distal end of the pressing arm 93 is pressed in contact with the circumference of the front opening of the opening portion 2, and biased in the direction to open the lid 5*a*. Thus, the hook portion 36*a* is pushed onto the inner peripheral surface of the locking portion 6*a*, which can prevent play of the hook portion 36*a* (see the arrow D in FIG. 17).

When the pusher 75 on the lid 5*a* is pushed in a state where the lid 5*a* is closed to the opening portion 2 of the glove box 1, the link rod 30*a* slides via the slant faces 77*a*, 39 against the biasing force of the biasing unit (not illustrated) toward the inside of the lid. After the locking bar 96 climbs over the holding protruding portion 91, then, the holding protruding portion 91 engages the circumference of the insertion hole 96*a* of the locking bar 96 in a state where the link rod 30*a* is pulled toward the inside of the lid from the pass-through hole 8*a*. Thus, the hook portion 36*a* is held in the state of disengaging the concave locking portion 6*a* (see FIG. 18). When the lid 5*a* is closed from this state, the distal end of the pressing arm 93 is brought into contact with the circumference of the front opening of the opening portion 2 of the glove box 1 to rotationally move the pressing arm 93 to make the locking bar 96 slide to disengage the holding protruding portion 91. Then, the link rod 30*a* is biased toward the outside of the lid by the biasing unit (not illustrated), and the hook portion 36*a* engages again the locking portion 6*a* (see FIG. 17).

In the present embodiment, by pushing the pusher 75 on the lid 5*d* (see the arrow G), the lid 5*b* is pressed in the direction to close the opening portion 2 of the glove box 1 while the distal end of the pressing arm 93 is pushed to rotationally move the pressing arm 93 via the supporting shaft 93*a*. Then, the locking bar 96 is interlocked with the pressing arm 93 to slide in a direction that the holding protruding portion 91 of the link rod 30*a* disengages the circumference of the insertion hole 96*a* (see the alternate long and two short dashes line in FIG. 17).

Thus, when the pusher 75 is pushed as indicated by the arrow G in a state where the lid 5*b* is closed, that is, in a state where the hook portion 36*a* of the link rod 30*a* engages the locking portion 6*a* and the hook portion of the link rod (not illustrated) engages the locking portion 6*a* while the locking bar 96 disengages the link rod 30*a*, the lid 5*b* is pressed in the arrow H direction together with the pusher 75. On the other hand, the pressing arm 93 is pressed by the circumference of the front opening of the opening portion 2 to move the locking bar 96 in the direction to disengage the link rod 30*a* (see the alternate long and two short dashes line in FIG. 17).

As a result, the link rod 30*a* can smoothly move in the direction that the hook portion 36*a* disengages the locking portion 6*a*, while the locking bar 96 is prevented from engaging the link rod 30*a*. The other link rod (not illustrated) that is interlocked with the link rod 30*a* also moves in the direction to disengage the locking portion 6*a*.

As described above, after one link rod 30*a* and the other link rod slide in the directions of disengaging the locking portions 6*a*, then, the holding protruding portion 91 of the link rod 30*a* engages the circumference of the insertion hole 96*a* of the locking bar 96. Thus, the hook portion 36*a* is held in the state of disengaging the concave locking portion 6*a*. Thus, from this state, the lid 5*b* opens due to its own weight or the like even when the hand is disengaged from the lid 5*b*. Thus, providing the pusher 75 that is the pushable operating member on the front surface of the lid 5*b* also allows the lid 5*b* to be opened and closed smoothly.

Figure 19:
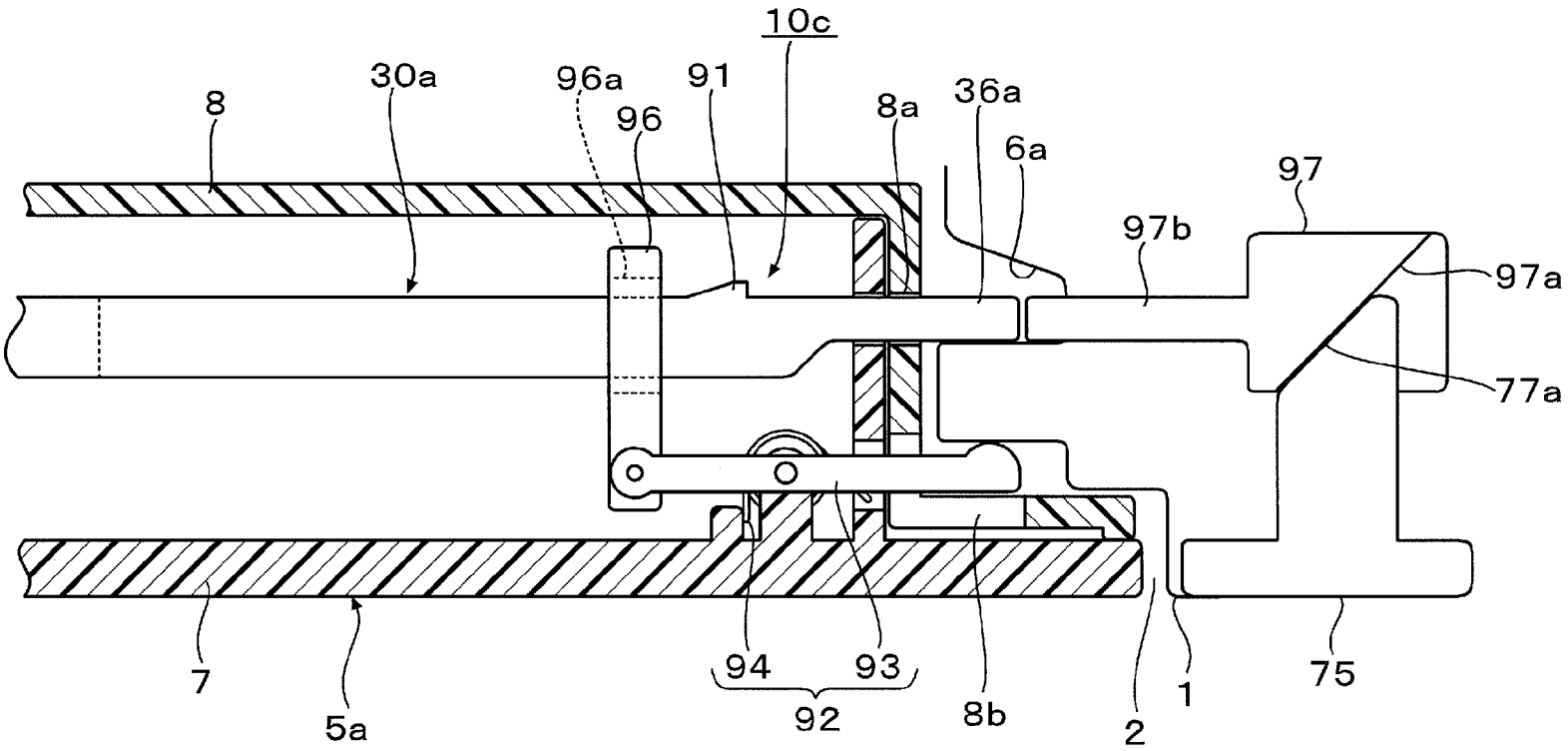
FIG. 19 An enlarged explanatory view of relevant components of an opening/closing body locking device according to the fourth embodiment of the present invention.

An opening/closing body locking device according to the fourth embodiment of the present invention is illustrated in FIG. 19. The same reference numerals are provided to the components that are substantially same as those in the above-described embodiment, and explanations of those components are omitted.

As shown in the enlarged explanatory view of relevant components of FIG. 19, an opening/closing body locking device 10*c* (hereinafter, referred to as the "locking device 10*c*") according to the present embodiment basically has the same configuration as the third embodiment where the pair of link rods are disposed in the lid, but is different from the third embodiment in that the pusher 75 is provided to the glove box 1.

To be specific, the pusher 75 is retained so as to be pushable at the circumference of the opening portion 2 of the glove box 1. A slider 97 including a slant face 97*a* and a pressing rod 97*b* protruding therefrom is disposed at a position adjacent to the pusher 75 such that the slider 97 is slidable along the width direction of the opening portion 2 of the glove box 1 and such that the pressing rod 97*b* is capable of protruding from and retract into the concave locking portion 6*a*.

When the pusher 75 is pushed in a state where the lid 5*a* is closed to the opening portion 2 of the glove box 1, the slider 97 slides against the biasing force of the biasing unit (not illustrated) via the slant faces 77*a*, 90*a*. Then, the slider 97 pushes the hook portion 36*a* of the link rod 30*a* toward the inside of the lid to release the engagement between the hook portion 36*a* and the concave locking portion 6*a*.

Figure 20:
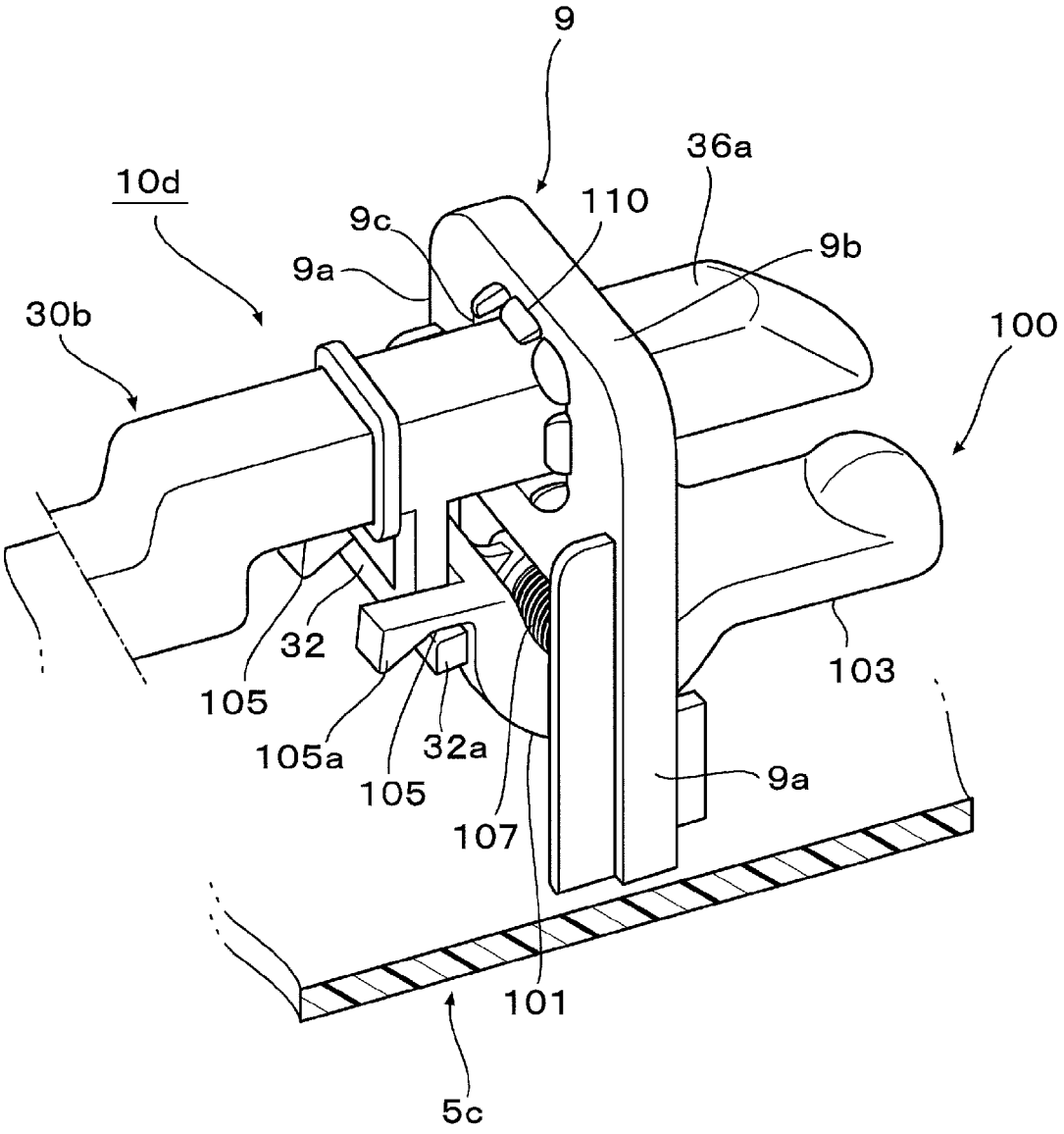
FIG. 20 An enlarged perspective view of relevant components of an opening/closing body locking device according to the fifth embodiment of the present invention.
Figure 21:
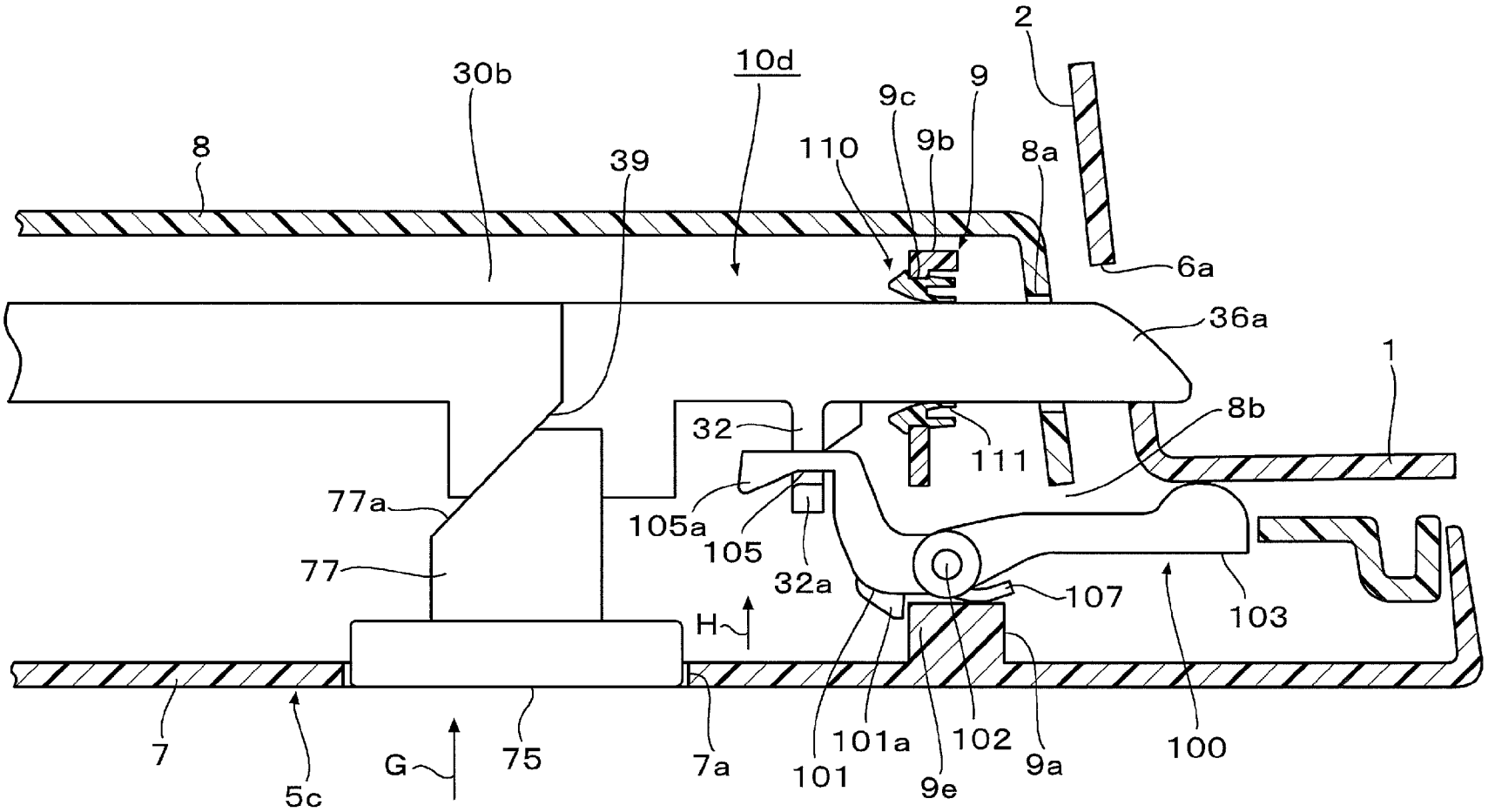
FIG. 21 An enlarged explanatory view of relevant components of the locking device where an opening/closing body is locked in a closed state with respect to an opening portion of a stationary body.
Figure 22:
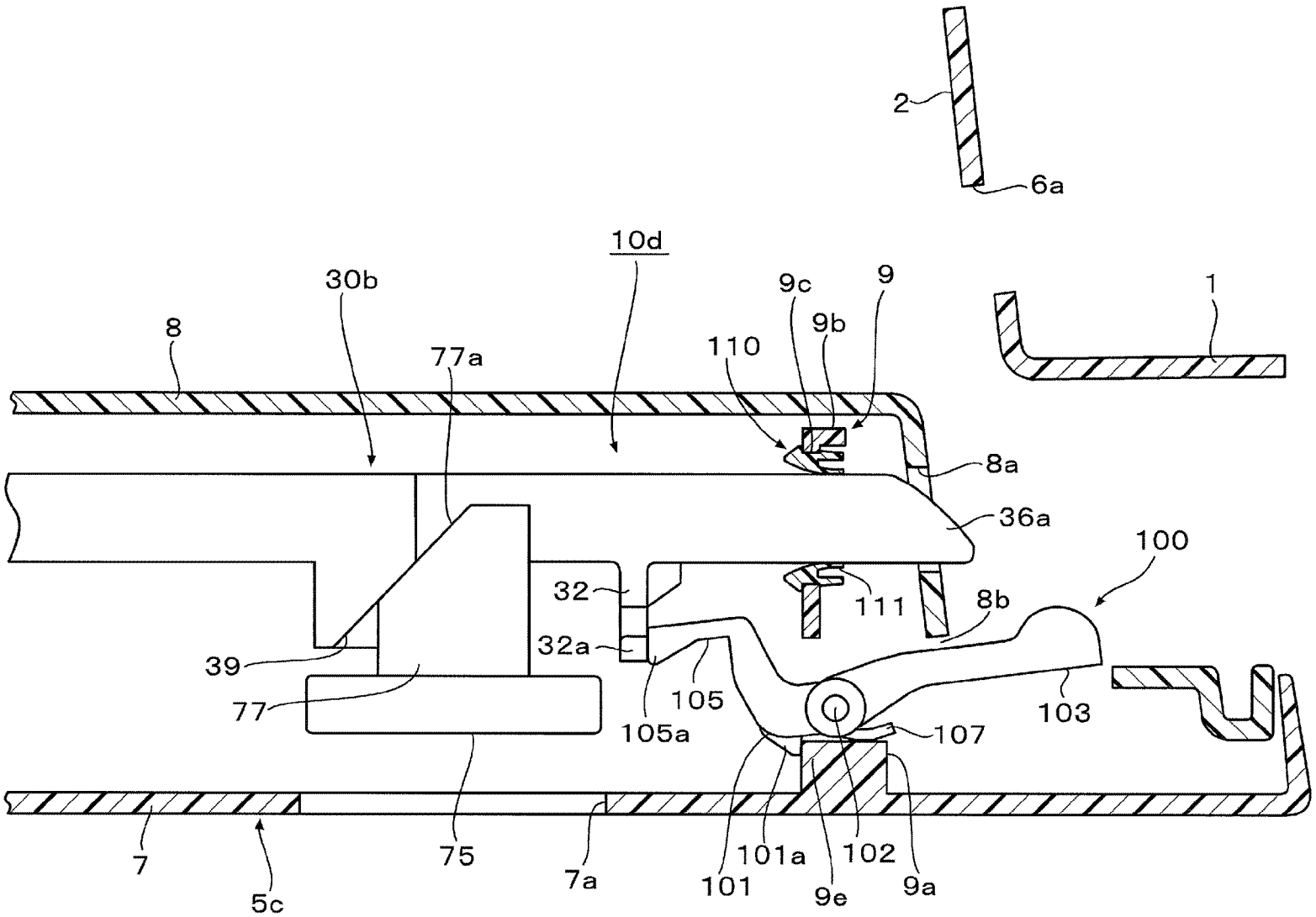
FIG. 22 An enlarged explanatory view of relevant components of the locking device where the locking state of the opening/closing body is released.

An opening/closing body locking device according to the fifth embodiment of the present invention is illustrated in FIGS. 20 to 22. The same reference numerals are provided to the components that are substantially same as those in the above-described embodiment, and explanations of those components are omitted.

An opening/closing body locking device 10*d* (hereinafter, referred to as the "locking device 10*d*") according to the present embodiment is different from the above-described embodiments in including a lever 100 integrating a pressing member and a holding unit.

The lid 5*c* according to the present embodiment has a structure approximately same as the lid 5*h* according to the third embodiment (see FIG. 17 and FIG. 18), and the pusher 75 that functions as the operating member is retained on the front surface of the lid 5*c* so as to be pushable. A pair of link rods (only one link rod 30*h* of the link rods is illustrated in FIGS. 20 to 22) are mounted in the interior space of the lid 5*c* so as to be slidable via a supporting member 9.

The supporting member 9 includes a pair of leg portions 9*a* projecting from the inner surface of the lid 5*c*, a plate portion 9*b* connecting the leg portions 9*a*, 9*a*, and a supporting hole 9*c* provided to the plate portion 9*b* and into which the link rod 30*b* is inserted. A guiding member 110 including an elastic hook 111 is provided to the inner periphery of the supporting hole 9*c*. The elastic hook 111 slidably guides the link rod 30*b* without play by being brought into elastically contact with the outer periphery of the link rod 30*b*.

A plate-shaped member 32 extends from one lateral surface of the hook portion 36*a* of the link rod 30*b* facing the panel 7 at a position apart from the distal end. Engaging protrusions 32*a*, 32*a* having a square pillar shape protrude from the plate-shaped member 32 on the both lateral sides in the width direction at the distal end.

The lever 100 is supported between the pair of the leg portions 9*a* of the supporting member 9 so as to be swingable via a supporting shaft 102. The lever 100 includes a main body portion 101 having a predetermined bent shape and attached to the leg portions 9*a* via the supporting shaft 102 so as to be swingable, a pressing arm 103 extending from one end of the main body portion 101, and a pair of holding hooks 105, 105 which are protruding to be elastically deformable from the both lateral sides of the other end of the main body portion 101 so as to engage and disengage the engaging protrusions 32*a* of the link rod 30*b*.

A torsional spring 107 is attached to the main body portion 101, and the distal end of the pressing arm 103 is biased toward the back side of the lid. The torsional spring 107 and the pressing arm 103 function as the "pressing member" in the present invention. The holding hooks 105 and the engaging protrusions 32*a* of the link rod 30*b* function as the "holding unit" in the present invention. The holding hooks 105 functions as the "holding member" in the present invention.

A rotational movement stopper 101*a* is provided to the main body portion 101 so as to protrude from the bent portion on the lateral surface facing the panel 7. Bringing the rotational movement stopper 101*a* into contact with a corner portion of a block 9*e* provided between the leg portions 9*a* of the supporting member 9 restricts the rotational movement angle of the lever 100 (see FIG. 22).

The holding hooks 105 are made thin at the base end sides so as to be flexible, and have engaging portions 105*a* having tapered surfaces that gradually become thicker at the distal end sides. In a state where the lid 5*c* is closed to the opening portion 2 of the glove box 1, the holding hooks 105 are disposed adjacent to the engaging protrusions 32*a* of the link rod 30*b*, and the engaging portions 105*a* of the holding hooks 105 are disposed closer to the base end of the link rod 30*b* than the engaging protrusions 32*a* as shown in FIG. 21.

When the pusher 75 on the lid 5*c* is pushed (see the arrow G) in a state where the lid 5*c* is closed to the opening portion 2 of the glove box 1, the link rod 30*b* slides against the biasing force of the biasing unit (not illustrated) via the slant faces 77*a*, 39 toward the inside of the lid. Then, the engaging protrusions 32*a* of the link rod 30*b* are brought into contact with the engaging portions 105*a* of the holding hooks 105 to move while elastically deforming the holding hooks 105 to climb over the engaging portions 105*a* of the holding hooks 105. Then, the engaging portions 105*a* engage the end faces of the engaging protrusions 32*a* on the distal end side of the hook portion. Thus, the hook portion 36*a* of the link rod 30*b* is held in the state of disengaging the concave locking portion 6*a* (see FIG. 22).

When the lid 5*c* is closed from this state, the distal end of the lever 100 is brought into contact with the circumference of the front opening of the opening portion 2 of the glove box 1. Then, the lever 100 rotationally moves via the supporting shaft 102, and the engaging portions 105*a* of the holding hooks 105 disengage the engaging protrusions 32*a*. Thus, the link rod 30*b* is biased toward the outside of the lid by the biasing unit (not illustrated), and the hook portion 36*a* engages again the locking portion 6*a* (see FIG. 21).

In the present embodiment, the holding hooks 105 that are elastically deformable are employed as the holding member of the holding unit, so that the holding hooks 105 are elastically deformed in moving the hook portion 36*a* of the link rod 30*b* so as to be in the state of disengaging the locking portion 6*a* of the glove box 1. Thus, the engaging protrusions 32*a* of the link rod 30*b* can climb over the holding hooks 105 to move, and can engage the holding hooks 105 in a state where the locking is released (see FIG. 22). Thus, the sliding movement of the link rod 30*b* can be smoothly performed, and release of the locking by the pusher 75 can be performed promptly.

In the present embodiment, the pressing arm 103 that constitutes the pressing member is provided to one end of the lever 100 mounted to the lid 5*c* while the holding hooks 105 that function as the holding member of the holding unit are provided to the other end. Thus, the pressing member and the holding unit can be easily mounted to the lid 5*c*. Because the pressing member and the holding unit are integrated, the thickness of the lid 5*c* can be reduced, and the space can be saved.

In the present embodiment, by pushing the pusher 75 on the lid 5*c* (see the arrow G), the lid 5*c* is pressed in the direction to close the opening portion 2 of the glove box 1 (see the arrow H) in a manner similar to the third embodiment while the distal end of the lever 100 is pushed to rotationally move via the supporting shaft 102. Then, the holding hooks 105 are interlocked with the lever 100 to move in the direction to disengage from the link rod 30*b*, that is, to rotationally move in the direction that the holding hooks 105 are slightly away from the engaging protrusions 32*a* of the link rod 30*b*.

This configuration allows the engaging protrusions 32*a* of the link rod 30*b* to easily climb over the holding hooks 105 of the lever 100, which allows the link rod 30*b* to smoothly move. When the engaging protrusions 32*a* of the link rod 30*b* climb over the holding hooks 105 of the lever 100, the engaging portions 105*a* engage the end faces of the engaging protrusions 32*a* on the distal end side of the hook portion, and the hook portion 36*a* of the link rod 30*b* is held in the state of disengaging the concave locking portion 6*a*. Thus, from this state, the lid 5*c* can be opened, for example, due to its own weight or the like even when the hand is disengaged from the lid 5*c*.

Figure 23:
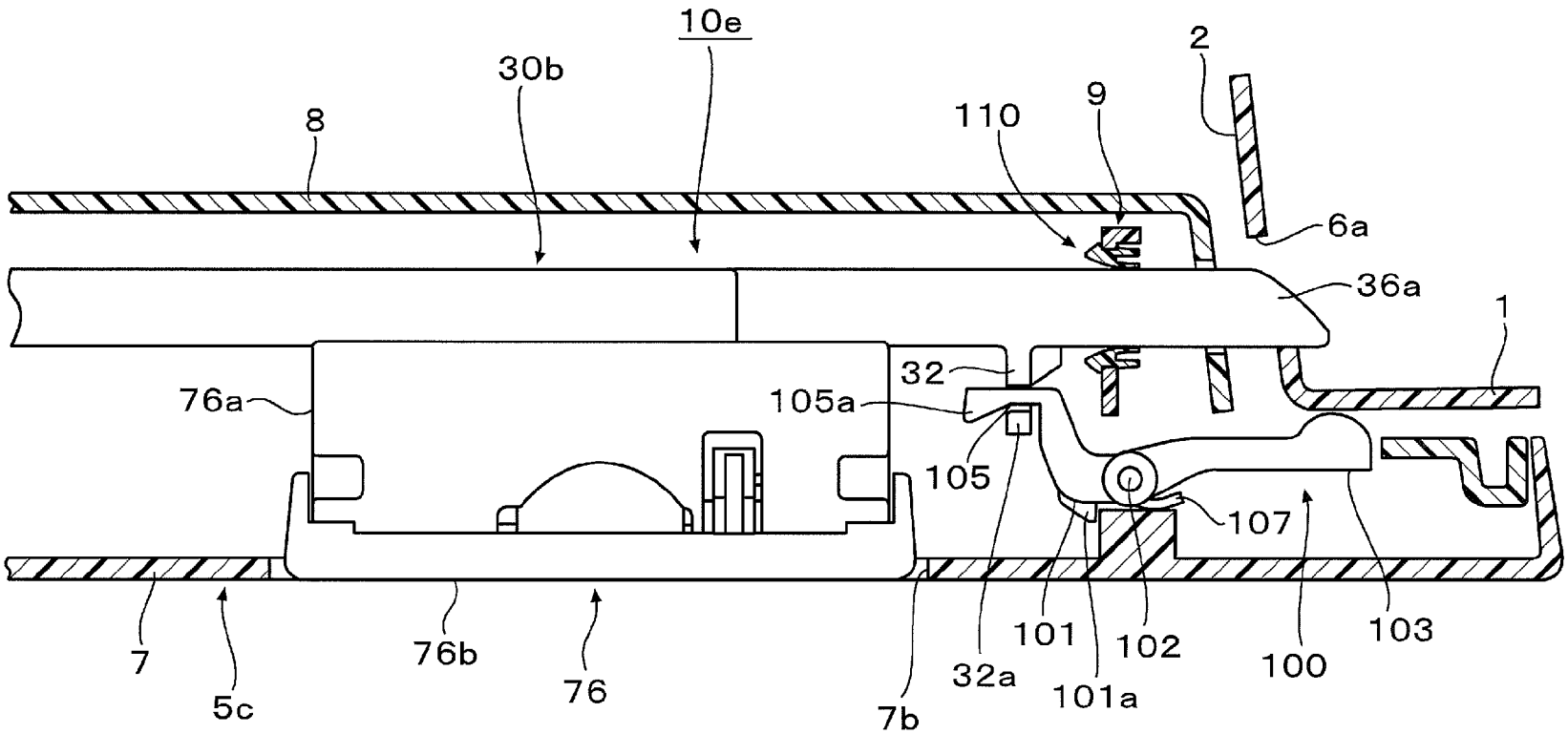
FIG. 23 An enlarged explanatory view of relevant components of an opening/closing body locking device according to the sixth embodiment of the present invention.
Figure 24:
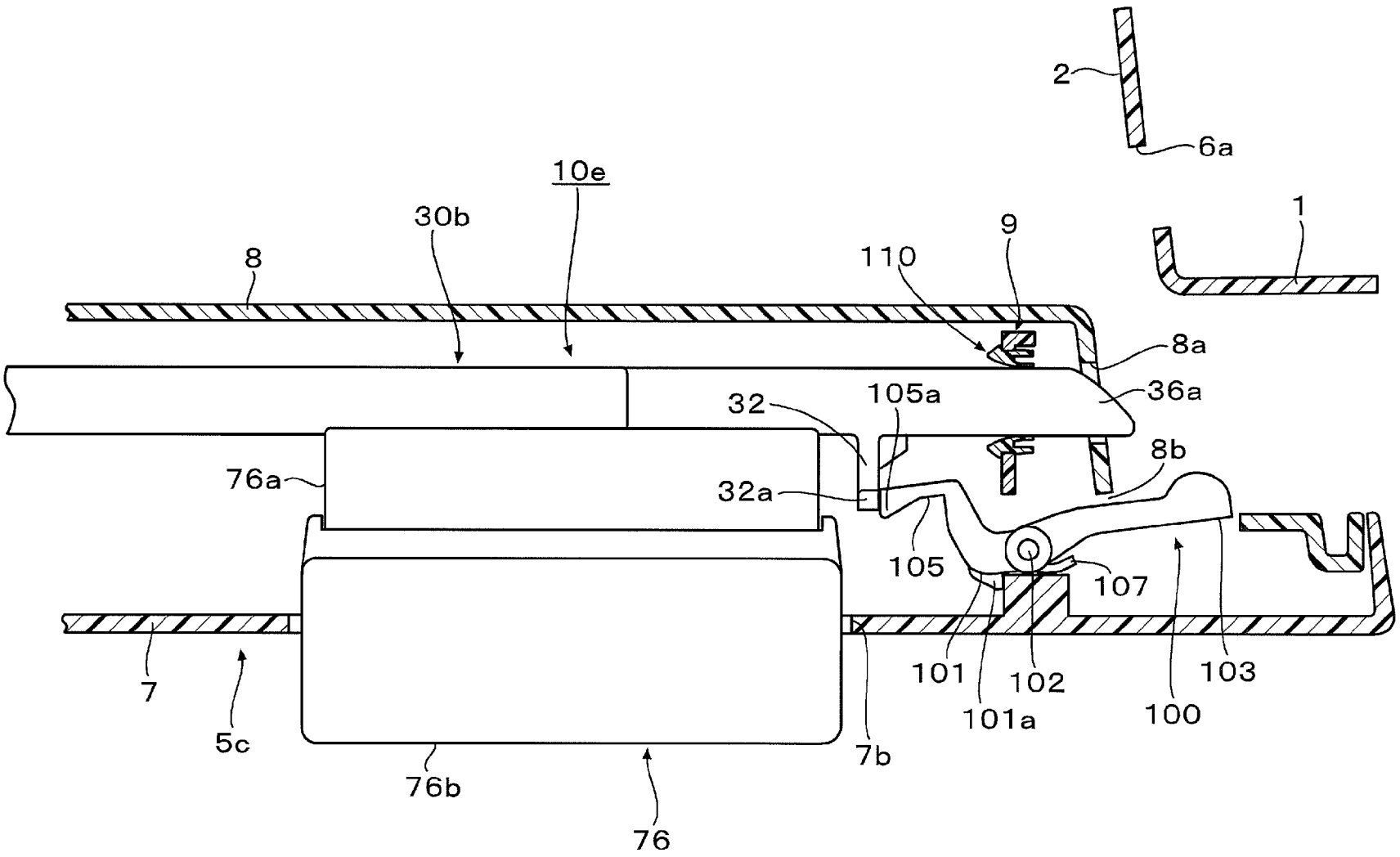
FIG. 24 An enlarged explanatory view of relevant components of the locking device where the locking state of the opening/closing body is released.

An opening/closing body locking device according to the sixth embodiment of the present invention is illustrated in FIG. 23 and FIG. 24. The same reference numerals are provided to the components that are substantially same as those in the above-described embodiment, and explanations of those components are omitted.

An opening/closing body locking device 10*e* (hereinafter, referred to as the "locking device 10*e*") according to the present embodiment is different from the locking device 10*d* according to the fifth embodiment in the operating member.

To be specific, an operating member 76 of the locking device 10*e* includes a housing 76*a* having a box shape, and a handle 76*b* attached to the front surface of the housing 76*a* so as to be rotatable. The operating member 76 is mounted to a handle mounting hole 7*b* of the lid 5*c* such that the handle 76*b* is capable of being pushed and pulled. The handle 76*b* at the upper portion on the both lateral sides in the width direction is supported by the housing 76*a* so as to be rotatable. A pressing protrusion (not illustrated) protrudes from the back surface of the handle 76*b*.

When the handle 76*b* is pulled in a state where the lid 5*c* is closed to the opening portion 2 of the glove box 1 (see FIG. 23), the pressing protrusion of the handle 76*b* presses a cam face (not illustrated) of the link rod 30*b* to slide the link rod 30*b* against the biasing force of the biasing unit toward the inside of the lid. Then, the engaging portions 105*a* of the holding hooks 105 engage the engaging protrusions 32*a*. Thus, the hook portion 36*a* of the link rod 30*b* is held in the state of disengaging the concave locking portion 6*a* (see FIG. 24).

The above-described configuration in which a link rod is pulled via a cam face by pulling a handle, for example, the known configuration of JP-A-2009-180028 can be employed, and thus, a detailed description thereof is omitted.

Although the opening/closing body locking devices according to the above-described embodiments are applied to the configurations that the lids 5, 5*a*, 5*b*, and 5*c* are openably/closably mounted to the opening portion 2 of the glove box 1, the present invention is not limited to these configurations. For example, the opening/closing body locking devices may be applied to a configuration in which a glove box is mounted to an opening portion of an instrument panel (the instrument panel functions as the "stationary body", and the glove box functions as the "opening/closing body") so as to be rotatable, a configuration in which a lid is openably/closably mounted to an opening portion of an instrument panel (the instrument panel functions as the "stationary body" and the lid functions as the "opening/closing body"), or the like. That is, the opening/closing body locking devices can be applied to a variety of opening and closing bodies that open and close opening portions of stationary bodies.

Although the above-described embodiments use the configurations that pushing the pusher directly or indirectly slides one of the link rods to interlock the other link rod to slide, the present invention is not limited to these configurations. For example, the configuration in the six embodiment shown in FIG. 23 and FIG. 24 that rotationally moving, or pushing or pulling the handle 76*b* slides the pair of link rods may be used. The pair of link rods are interlocked with each other via the rotor; however, the present invention is not limited to this configuration. For example, there may be used a configuration in which a pinion gear is used instead of the rotor while rack grooves are respectively provided to the pair of link rods so as to gear with the pinion gear, so that the other one of the link rods slides in response to sliding of one of the link rods via the pinion gear.

While the pressing members are provided on the both lateral sides of the opening portion of the glove box or on the both lateral sides of the lid, and the holding unit is provided to the glove box on one lateral side of the opening portion or on one lateral side of the lid in the above-described embodiments, the holding unit may be provided to the glove box on the both lateral sides of the opening portion or on the both lateral sides of the lid so as to be interlocked with both the pressing members. According to this embodiment, because the holding unit is provided to the glove box on the both lateral sides of the opening portion or on the both lateral sides of the lid, the pressing members on the both lateral sides are pressed when the opening/closing body is closed, and the holding unit on the both lateral sides is interlocked with the pressing members to release the engagement with the link rods. Then, the link rods are slid by the biasing unit to make the hook portions engage the locking portions. Thus, an accident (so-called "one engagement") that only a hook portion of one of the link rods engages a locking portion can be avoided, and the hook portions of the pair of link rods are allowed to reliably engage the locking portions.

DESCRIPTION OF REFERENCE NUMERALS AND SIGNS

1 Glove box (stationary body)
2 Opening portion
2*a*, 2*b* Mounting concave portion
5, 5*a*, 5*b*, 5*c* Lid (opening/closing body)
6, 6*a* Locking portion
10, 10*a*, 10*b*, 10*c*, 10*d*, 10*e* Locking device
20 Link rod
23 Hook portion
30, 30*a*, 30*b* Link rod
33 Slider
36, 36*a* Hook portion
37 Holding protruding portion
40 Rotor
43 Torsional spring
50 Bezel
51 Concave portion
55 Pressing member
60 Housing
70 Key cylinder
71 Cover
73 Striker
75 Pusher
76 Operating member
80 Holder
81 Concave portion
87 Holding lever
96 Locking bar
100 Lever
103 Pressing arm
105 Holding hook

The invention claimed is:

1. An opening/closing body locking device for an opening/closing body that is openably/closably mounted to an opening portion of a stationary body, the locking device comprising:

locking portions provided on lateral sides of the opening/closing body, wherein a first locking portion of the locking portions is provided on a first lateral side of the lateral sides of the opening/closing body and a second locking portion of the locking portions is provided on a second lateral side of the lateral sides of the opening/closing body such that the first and second locking portions are provided on both of the first and second lateral sides of the opening/closing body;

a pair of link rods that are slidably mounted to the stationary body and include hook portions, wherein a first link rod of the pair of link rods includes a first hook portion of the hook portions at a distal end of the first link rod of the pair of link rods and wherein a second link rod of the pair of link rods includes a second hook portion of the hook portions at a distal end of the second link rod of the pair of link rods;

a biasing unit that biases, via a biasing force, the first and second link rods in directions such that the first and second hook portions at the distal end of the first link rod of the pair of link rods and at the distal end of the second link rod the pair of link rods respectively engage the first and second locking portions;

an operating member, operation of which causes the first and second link rods to slide in other directions against the biasing force of the biasing unit such that the first and second hook portions disengage from the first and second locking portions, respectively;

pressing members that are provided on both of the first and second lateral sides of the opening portion of the stationary body, and press the opening/closing body in a direction to open the opening/closing body in a state where the first and second hook portions engage the first and second locking portions while the opening/closing body closes the opening portion; and a holding unit that holds the first and second hook portions in a state where the first and second hook portions are disengaged from the first and second locking portions against the biasing force of the biasing unit after the first and second link rods are slid in the other directions by the operation of the operating member, and releases the holding of the first and second hook portions, causing the first and second hook portions to engage the first and second locking portions when the opening/closing body closes the opening portion, wherein, when the opening/closing body closes the opening portion, the holding unit contacts a part of the pair of the first and second link rods, wherein the stationary body includes concave portions that receive the first and second locking portions when the opening/closing body closes the opening portion, wherein the first and second link rods are biased by the biasing unit in the directions such that the first and second hook portions approach each other, and wherein, when the opening/closing body closes the opening portion, the first and second hook portions block the concave portions to thereby retain the first and second locking portions within the concave portions.

2. The opening/closing body locking device of claim 1, wherein, in the state where the first and second hook portions engage the first and second locking portions while the opening/closing body closes the opening portion of the stationary body, the first and second hook portions and the pressing members are disposed at opposite positions sandwiching the first and second locking portions therebetween.

3. The opening/closing body locking device of claim 1, wherein, when the first and second link rods are slid in the other directions to disengage the first and second hook portions from the first and second locking portions by the operation of the operating member, the holding unit is interlocked with one of the pressing members provided on one lateral side, and is moved by a biasing force of one of the pressing members to engage one of the first and second link rods to thereby hold the first and second hook portions in the state where the first and second hook portions are disengaged from the first and second locking portions, wherein when the opening/closing body closes the opening portion, an associated one of the first and second locking portions presses the one of the pressing members such that the holding of the first and second hook portions by the holding unit is released.

4. The opening/closing body locking device of claim 1, wherein the operating member is connected to the distal end of only one of the first and second link rods.

5. The opening/closing body locking device of claim 1, wherein a spring is provided around each of the pressing members to bias the pressing member towards the first and second locking portions.

6. The opening/closing body locking device of claim 1, wherein the holding unit is movably mounted orthogonal to the pressing members.

7. The opening/closing body locking device of claim 1, wherein the holding unit includes a holding lever and a distal end portion, and wherein the holding unit is disposed such that the distal end portion is disposed above a slant face of a holding protruding portion of one of the first and second link rods in the state where the first and second hook portions are biased to engage the first and second locking portions, respectively.

8. The opening/closing body locking device of claim 7, wherein the holding unit rotatably moves to swing in a direction such that the distal end portion moves away from the holding protruding portion with a base end side of the holding unit acting as a pivot center.

9. The opening/closing body locking device of claim 1, wherein the holding unit includes a hook groove shape on a base end side.

10. The opening/closing body locking device of claim 9, wherein, when the opening/closing body closes the opening portion, the holding unit engages with one of the pressing members via the hook groove shape.

11. The opening/closing body locking device of claim 10, wherein, when the opening/closing body closes the opening portion, one of the first and second locking portions presses a corresponding one of the pressing members to release an engagement between the hook groove shape of the holding unit and the one of the first and second link rods having at the distal end thereof the one of the first and second locking portions to release the holding state of the first and second hook portions.

* * * * *